US011193508B2

(12) United States Patent
Hughes et al.

(10) Patent No.: US 11,193,508 B2
(45) Date of Patent: Dec. 7, 2021

(54) HYDRAULIC POWER SYSTEM AND METHOD FOR CONTROLLING SAME

(71) Applicant: Enerpac Tool Group Corp., Menomonee Falls, WI (US)

(72) Inventors: Nathan Adam Hughes, Cottage Grove, WI (US); Curtis L. Van Weelden, Waukesha, WI (US); Benjamin W. Keeton, San Diego, CA (US)

(73) Assignee: Enerpac Tool Group Corp., Menomonee Falls, WI (US)

( * ) Notice: Subject to any disclaimer, the term of this patent is extended or adjusted under 35 U.S.C. 154(b) by 0 days.

(21) Appl. No.: 16/682,991

(22) Filed: Nov. 13, 2019

(65) Prior Publication Data

US 2020/0149561 A1 May 14, 2020

Related U.S. Application Data

(60) Provisional application No. 62/760,880, filed on Nov. 13, 2018.

(51) Int. Cl.
*F15B 9/03* (2006.01)
*F15B 21/0423* (2019.01)
(Continued)

(52) U.S. Cl.
CPC ..... *F15B 9/03* (2013.01); *F15B 7/008* (2013.01); *F15B 11/028* (2013.01); *F15B 15/18* (2013.01);
(Continued)

(58) Field of Classification Search
CPC .. F15B 9/03; F15B 9/09; F15B 11/028; B25B 21/005; B25B 23/1456
See application file for complete search history.

(56) References Cited

U.S. PATENT DOCUMENTS 1,850,083 A 3/1932 Noltein
3,053,186 A 9/1962 Gondek
(Continued)

FOREIGN PATENT DOCUMENTS

CN 201836150 U 5/2011
CN 101900153 A 7/2012
(Continued)

OTHER PUBLICATIONS

PCT Notification with Search Report for related Application No. PCT/US2018/033060 dated Jul. 24, 2018 (14 pages).
(Continued)

*Primary Examiner* — Michael Leslie
(74) *Attorney, Agent, or Firm* — Michael Best & Friedrich LLP

(57) ABSTRACT

A system and method is provided for monitoring a hydraulic power system having at least one light emitter and a button. The method includes powering on the hydraulic power system, receiving an actuation at the button and detecting a release of the button after a first time interval, and entering a diagnostic state. The method further includes retrieving a code and displaying the code by turning on the emitter in a first pattern. In some embodiments, a system and method is provided for regulating a temperature of a hydraulic power system. In some embodiments, a system and method is provided for controlling operation of a hydraulic torque wrench.

18 Claims, 18 Drawing Sheets

(51) Int. Cl.

| | |
|---|---|
| ***F15B 7/00*** | (2006.01) |
| ***F15B 15/18*** | (2006.01) |
| ***F15B 19/00*** | (2006.01) |
| ***F15B 20/00*** | (2006.01) |
| ***F15B 11/028*** | (2006.01) |
| *B25B 21/00* | (2006.01) |

(52) U.S. Cl.
CPC ..... *F15B 19/005* (2013.01); *F15B 20/007* (2013.01); *F15B 21/0423* (2019.01); *B25B 21/005* (2013.01)

(56) References Cited

U.S. PATENT DOCUMENTS

| | | | | |
|---|---|---|---|---|
| 3,487,431 | A | 12/1969 | Forkner | |
| 3,992,133 | A | 11/1976 | Brunner | |
| 4,597,717 | A | 7/1986 | Mohr | |
| 4,692,104 | A | 9/1987 | Hansen | |
| 4,791,838 | A * | 12/1988 | Bickford | B25B 21/005 73/708 |
| 4,834,632 | A | 5/1989 | Gatecliff et al. | |
| 4,864,903 | A | 9/1989 | Bickford et al. | |
| 5,113,949 | A * | 5/1992 | Ohkubo | B25B 23/1456 173/177 |
| D327,075 | S | 6/1992 | Tiedemann | |
| 5,121,788 | A | 6/1992 | Carollo | |
| 5,181,837 | A | 1/1993 | Niemiec | |
| 5,261,796 | A | 11/1993 | Niemiec et al. | |
| 5,320,501 | A | 6/1994 | Langosch et al. | |
| 5,421,240 | A * | 6/1995 | Ohta | B25B 23/1453 173/177 |
| 5,668,328 | A * | 9/1997 | Steber | B25B 21/005 73/862.23 |
| D447,148 | S | 8/2001 | Antony et al. | |
| 6,863,502 | B2 | 3/2005 | Bishop et al. | |
| 7,036,892 | B2 | 5/2006 | Suzuki et al. | |
| D536,705 | S | 2/2007 | Griffin et al. | |
| D557,708 | S | 2/2007 | Carpenter et al. | |
| 7,200,992 | B2 * | 4/2007 | Wagner | B25B 21/005 60/379 |
| D573,609 | S | 7/2008 | Bilger | |
| D604,746 | S | 11/2009 | Nishido et al. | |
| 7,743,673 | B2 * | 6/2010 | Wagner | B25B 23/145 73/862.23 |
| 7,762,790 | B2 | 7/2010 | Steinfels et al. | |
| 7,878,765 | B2 | 2/2011 | Gonnella et al. | |
| 7,931,448 | B2 | 4/2011 | Achor et al. | |
| 8,056,426 | B2 | 11/2011 | Hohmann et al. | |
| 8,220,380 | B2 | 7/2012 | Andres et al. | |
| 8,305,019 | B2 | 11/2012 | Tobari et al. | |
| D707,719 | S | 6/2014 | Kamijyo | |
| D712,933 | S | 9/2014 | DeOreo et al. | |
| D713,860 | S | 9/2014 | Pedrollo | |
| 8,997,904 | B2 | 4/2015 | Cryer et al. | |
| 9,115,720 | B2 | 8/2015 | Rosinski et al. | |
| 9,193,046 | B2 * | 11/2015 | Landrum | F15B 11/15 |
| 9,193,049 | B2 * | 11/2015 | Gareis | F15B 13/0442 |
| 9,212,655 | B2 | 12/2015 | Neumair | |
| 9,435,324 | B2 | 9/2016 | Richardson et al. | |
| 9,562,534 | B2 | 2/2017 | Rosinski et al. | |
| 9,587,639 | B2 | 3/2017 | Rosinski et al. | |
| D785,679 | S | 5/2017 | Hartung | |
| D786,939 | S | 5/2017 | Nelson et al. | |
| D810,145 | S | 2/2018 | Sinico | |
| D822,718 | S | 7/2018 | Hartung | |
| D826,282 | S | 8/2018 | Mead et al. | |
| D826,283 | S | 8/2018 | Mead et al. | |
| D838,746 | S | 1/2019 | Gan | |
| D847,266 | S | 5/2019 | Janardhan et al. | |
| D850,490 | S | 6/2019 | Janardhan et al. | |
| 10,564,657 | B2 * | 2/2020 | Chu | B25B 23/1456 |
| D878,423 | S | 3/2020 | Andersson et al. | |
| 2003/0012672 | A1 | 1/2003 | Sowa et al. | |
| 2004/0045729 | A1 * | 3/2004 | Lehnert | B25B 23/145 173/1 |
| 2005/0210872 | A1 | 9/2005 | Wagner | |
| 2007/0214921 | A1 | 9/2007 | Fechter et al. | |
| 2007/0217928 | A1 | 9/2007 | Isobe et al. | |
| 2008/0265844 | A1 | 10/2008 | Smith et al. | |
| 2009/0000397 | A1 | 1/2009 | Wagner et al. | |
| 2010/0021313 | A1 | 1/2010 | Devan et al. | |
| 2010/0116508 | A1 | 5/2010 | Oglesby | |
| 2011/0206537 | A1 | 8/2011 | Simpson | |
| 2013/0115108 | A1 | 5/2013 | Segal | |
| 2013/0315758 | A1 | 11/2013 | Olson | |
| 2014/0328704 | A1 | 11/2014 | Neumair | |
| 2015/0147953 | A1 | 5/2015 | Park et al. | |
| 2015/0300138 | A1 | 10/2015 | Michel | |
| 2015/0345489 | A1 | 12/2015 | Fink | |
| 2016/0366824 | A1 | 12/2016 | Richardson et al. | |
| 2017/0107804 | A1 | 4/2017 | Krug et al. | |
| 2017/0356438 | A1 | 12/2017 | Hughes | |

FOREIGN PATENT DOCUMENTS

| | | | |
|---|---|---|---|
| EP | 2110205 | A2 | 10/2009 |
| JP | 2000274377 | A | 10/2000 |
| RU | 1830114 | A3 | 7/1993 |
| WO | WO9420753 | A2 | 9/1994 |
| WO | WO2008029624 | A1 | 3/2008 |
| WO | 2016133874 | A1 | 8/2016 |
| WO | 2017/060777 | A2 | 4/2017 |

OTHER PUBLICATIONS

International Search Report with Wittent Opinion for related Application No. PCT/US2018/033060 dated Sep. 24, 2018 (19 pages).
Office Action issued from the US Patent Office for related U.S. Appl. No. 15/981,869 dated Oct. 30, 2020 (18 Pages).
Extended Search Report issued from the European Patent Office for related Application No. 19208915.9 dated Mar. 31, 2020 (11 Pages).
Atlas Copco AB, "SP700 Smart Pump", Product Brochure, https://www.atlascopco.com/content/dam/atlas-copco/industrial-technique/general/documents/brochures-leaflets/hydraulic-tools/SP-01_SmartTorquePump_2018-09-03.pdf, 4 Pages.
Atlas Corp., "SP700 Smart Pump", Youtube video (https://www.youtube.com/watch?v=ZvysvFf1_BE), dated Aug. 2, 2019, 4 Screenshots.
Final Office Action issued from the US Patent Office for related U.S. Appl. No. 15/981,869 dated May 10, 2021 (25 pages including form 892).

* cited by examiner

HYDRAULIC POWER SYSTEM AND METHOD FOR CONTROLLING SAME

REFERENCE TO RELATED APPLICATION

This application claims the benefit of co-pending, prior-filed U.S. Provisional Patent Application No. 62/760,880, filed Nov. 13, 2018, the entire contents of which are incorporated by reference.

BACKGROUND

The present disclosure relates to hydraulic power systems, and particularly to hydraulic power systems and methods for controlling a hydraulic power system.

SUMMARY

In one independent aspect, a method is provided for monitoring a hydraulic power system. The hydraulic power system includes at least one light emitter and a button. The method includes actuating the button and releasing the button after a first time interval, and entering a diagnostic state. The method further includes retrieving a code and displaying the code by turning on the emitter in a first pattern.

In another independent aspect, a system is provided for monitoring a hydraulic power system.

In yet another independent aspect, a method is provided for regulating a temperature of a hydraulic power system. The hydraulic power system includes a cooling fan and a motor. The method includes measuring an ambient temperature, measuring a motor control bridge temperature, and monitoring an oil temperature switch. The method further includes powering the fan in a first on mode or a second on mode to cool at least one of a fluid of the hydraulic pump, a motor, and a motor controller. The fan is powered in the first one mode when the motor is in an on mode and a first temperature condition is met. The first temperature condition includes an ambient temperature or a motor controller bridge temperature. The fan is powered in the second on mode when the oil temperature switch is in an open position or when the motor controller bridge temperature is above a first motor controller bridge threshold.

In yet another independent aspect, a system is provided for regulating a hydraulic power system.

In yet another independent aspect, a method is provided for operating a hydraulic power system coupled to a torque wrench. The hydraulic power system includes a motor, a valve, and a controller. The method includes actuating a first button of the controller and starting an auto-cycle, advancing a fluid actuator of the torque wrench, and measuring a change in pressure of fluid in the fluid actuator of the torque wrench. The method further includes comparing the change in pressure per unit time to a stored pressure slope and retracting the fluid actuator of the torque wrench when the change in pressure is greater than a stored pressure slope.

In yet another independent aspect, a system is provided for controlling operation of a hydraulic power system coupled to a torque wrench.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

Figure 1:
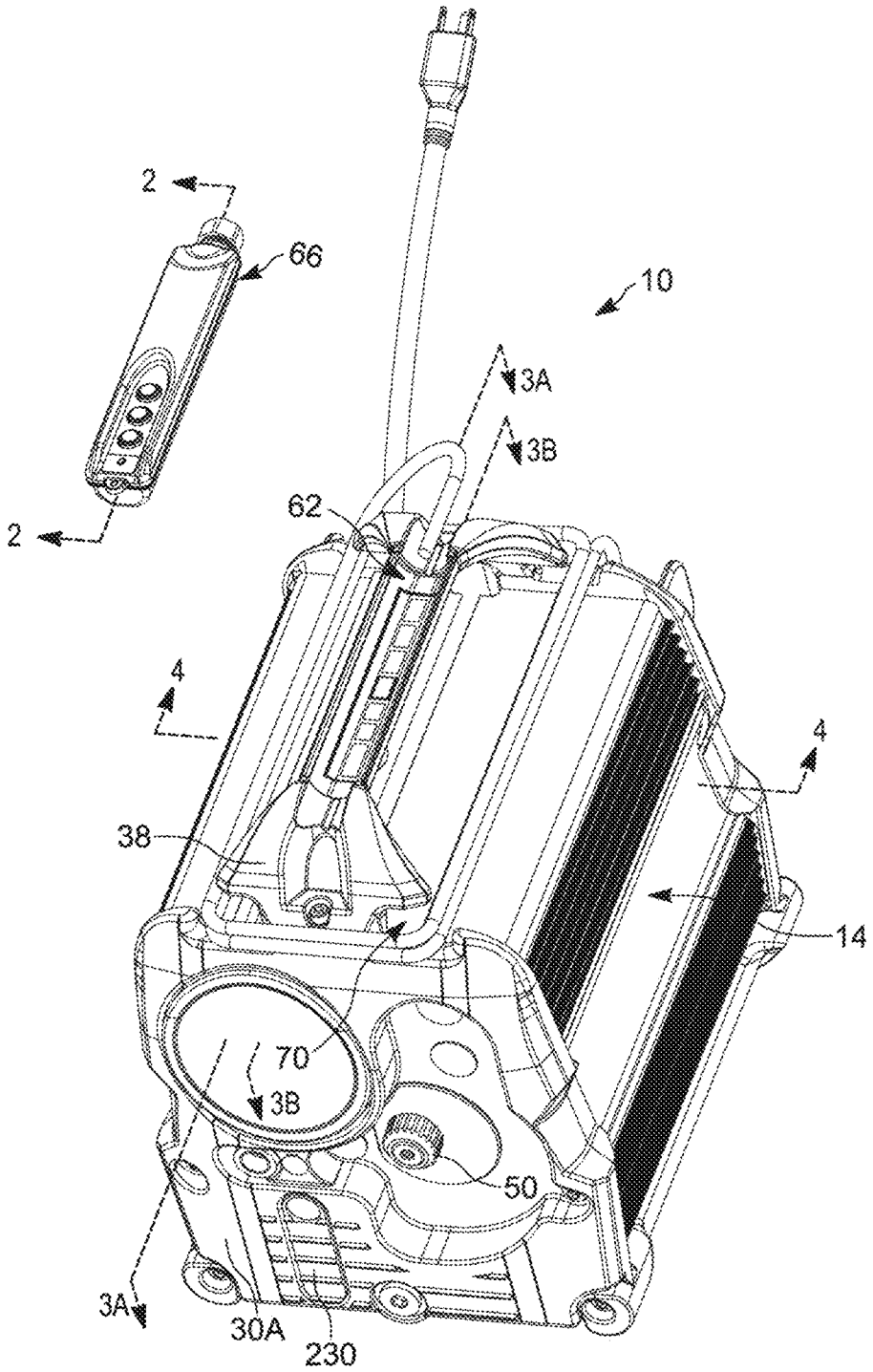
FIG. 1 is a perspective view of a hydraulic power system and a remote control.
Figure 3A:
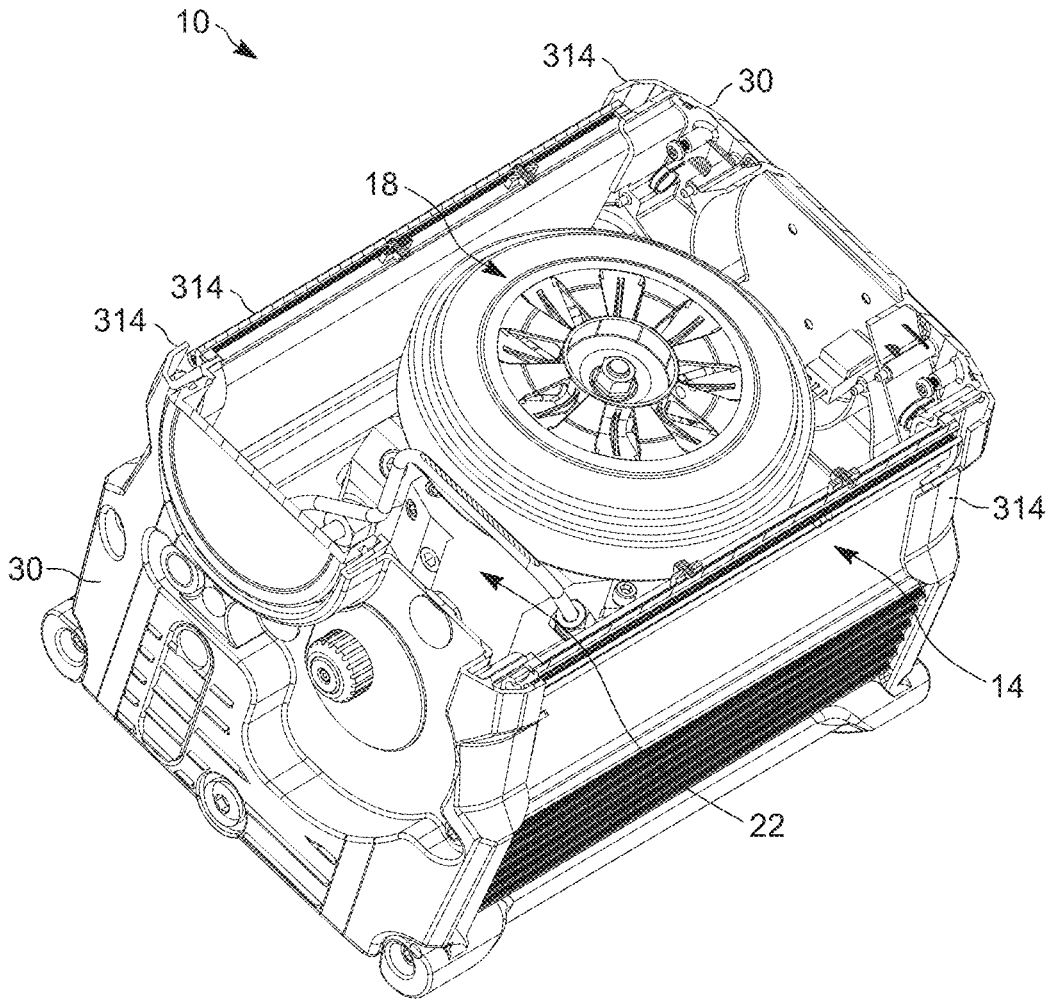
FIG. 3A is a cross-sectional view of the hydraulic power system shown in FIG. 1 viewed along section 3A-3A.
Figure 11:
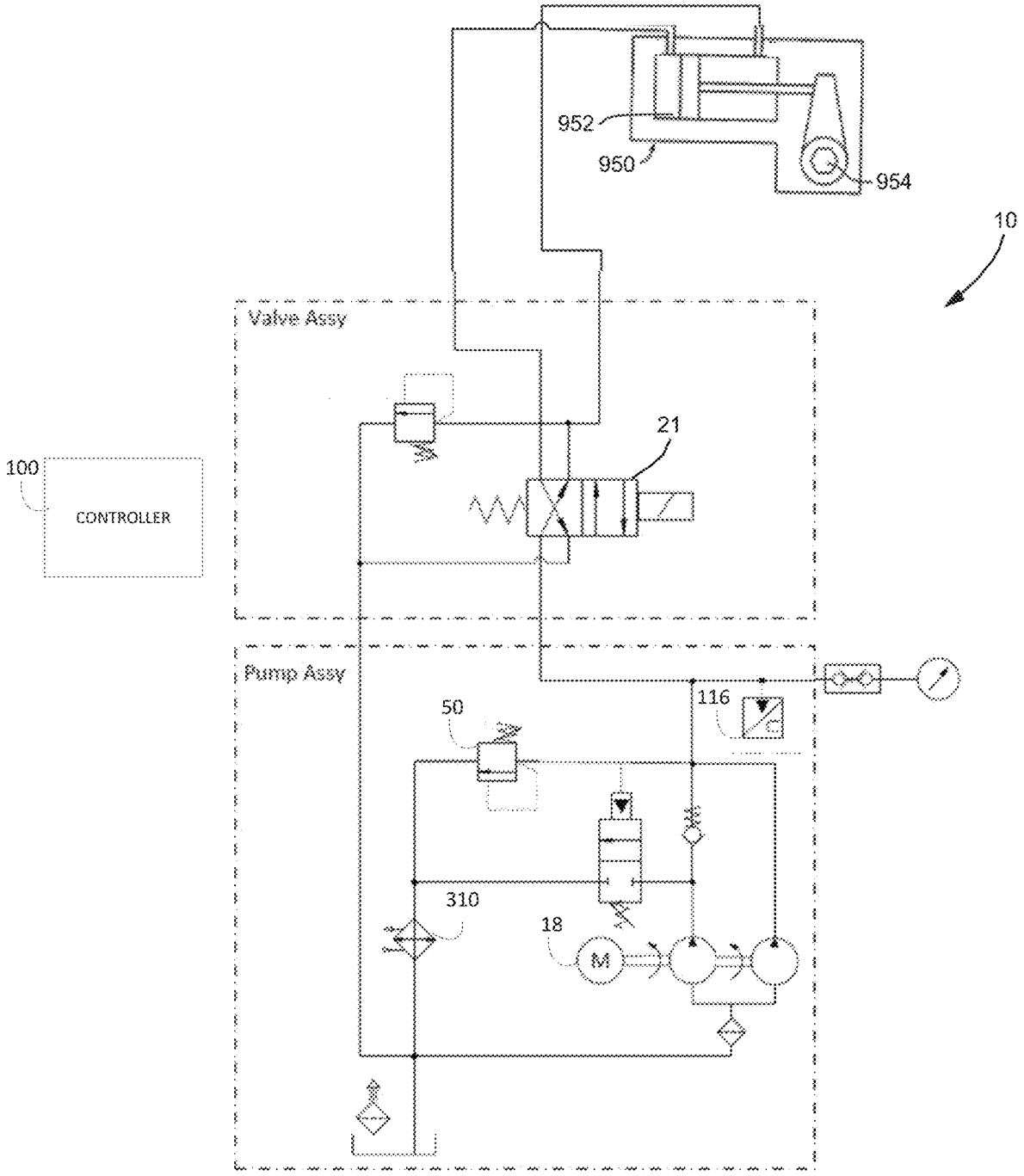
FIG. 11 is a block diagram illustrating a hydraulic torque wrench system of the hydraulic power system of FIG. 1

FIGS. 1 and 11 illustrate a hydraulic power system 10. The hydraulic power system 10 includes a housing or frame 14 and a handle 38. As shown in FIG. 3A, the frame 14 supports a motor 18 operable to drive a pump 22. In the illustrated construction, the motor 18 can include a brushless permanent magnet synchronous motor (PMSM), a permanent magnet AC motor (PMAC), an electrically-commutated motor (EC), or a brushless DC motor (BLDC). The illustrated pump 22 includes a multi-stage, variable displacement hydraulic pump driven by the motor 18 controlled to provide a substantially constant power output during each stage of operation. During operation, a motor speed is adjusted to maintain peak power (for example, based on motor load/current) to provide optimum flow rate throughout the pressure range.

As shown in FIG. 1, the handle 38 is coupled to the frame 14. In the illustrated embodiment, the handle 38 provides storage (e.g., a receptacle 62) for a remote controller, such as a pendant 66. A retainer device 286 (FIG. 2) removably couples the pendant to the handle 38. In the illustrated embodiment, the retainer device 286 includes one or more magnets; although in other embodiments the retainer assembly may include a detent, a strap, etc. In addition, a cord wrap feature 70 (e.g., notches or grooves) is provided on the frame assembly 14 to receive a power cord of the hydraulic power system 10 and/or a cable of a pendant 66. In the illustrated embodiment, the cord wrap feature 70 is positioned adjacent the base ends of the handle 38.

Figure 2:
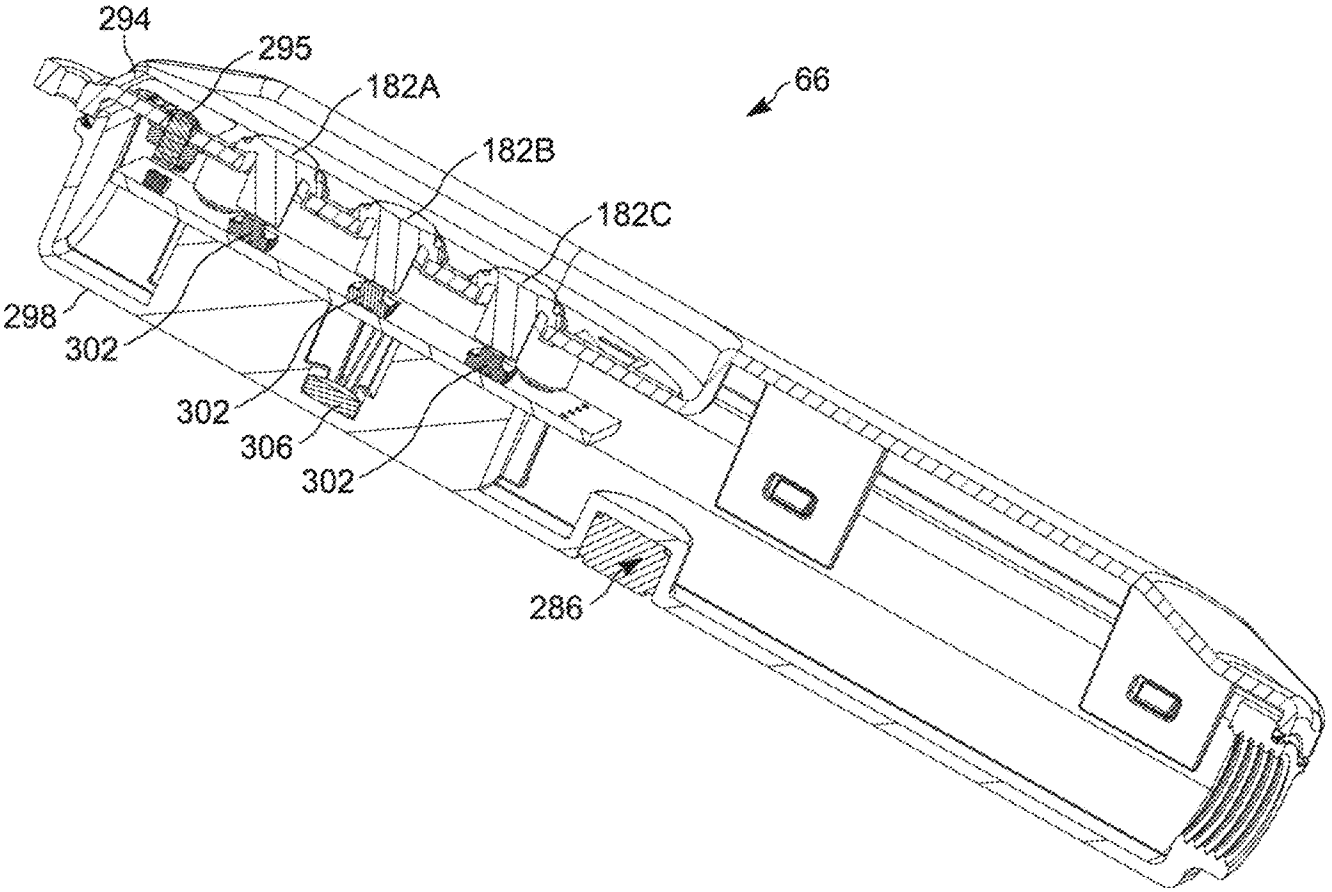
FIG. 2 is a cross-sectional view of the remote control shown in FIG. 1 viewed along section 2-2.

As shown in FIG. 2, the pendant 66 includes a first portion 294 and a second portion 298. The first portion 294 includes actuators or buttons 182A, 182B, 182C. In the illustrated embodiment, the first portion 294 includes three buttons 182A, 182B, 182C and include an outer surface made from rubber (or a similar synthetic material), and the buttons 182A, 182B, 182C are overmolded onto the first portion 294. A user input (e.g., pushing one of the buttons 182A, 182B, 182C) actuates an associated control switch 302, sending a signal to a controller 100 (FIG. 10) of the hydraulic power system 10.

The pendant 66 includes at least one haptic motor 306. The haptic motor 306 provides tactile feedback (e.g., vibrations) when the switches 302 are actuated. In some embodiments, the haptic motor 306 may be capable providing more than one type of feedback (e.g., a different number of pulses, different intensities of vibrations, etc.). Among other things, the feedback may alert a user that one or more buttons 182 was sufficiently pressed and/or that the controller 100 (FIG. 10) received a command to modify operation of the motor 18 and/or pump 22. In the illustrated embodiment, the pendant 66 also includes a light-emitting device (e.g., a light-emitting diode or LED) 295 to provide visual feedback to the user. The LED 295 may emit light in a variety of patterns (e.g., continuously on, short blinks, long blinks, etc.). The LED 295 may also emit light in a variety of colors (e.g., red, yellow, green, etc.).

A user may actuate the input devices on the pendant 66 in order to modify operation of the hydraulic power system 10 and access diagnostic information of the hydraulic power system 10. At various times during the life of the hydraulic power system 10, one or more system errors or error conditions may arise. The hydraulic power system 10 can communicate system errors with the user so that the errors can be corrected.

In the illustrated embodiment, system errors are communicated to a user via the pendant 66. Specifically, the LED 295 and the haptic motor 306 provide visual and tactile feedback in order to communicate specific system errors to the user.

Figure 5:
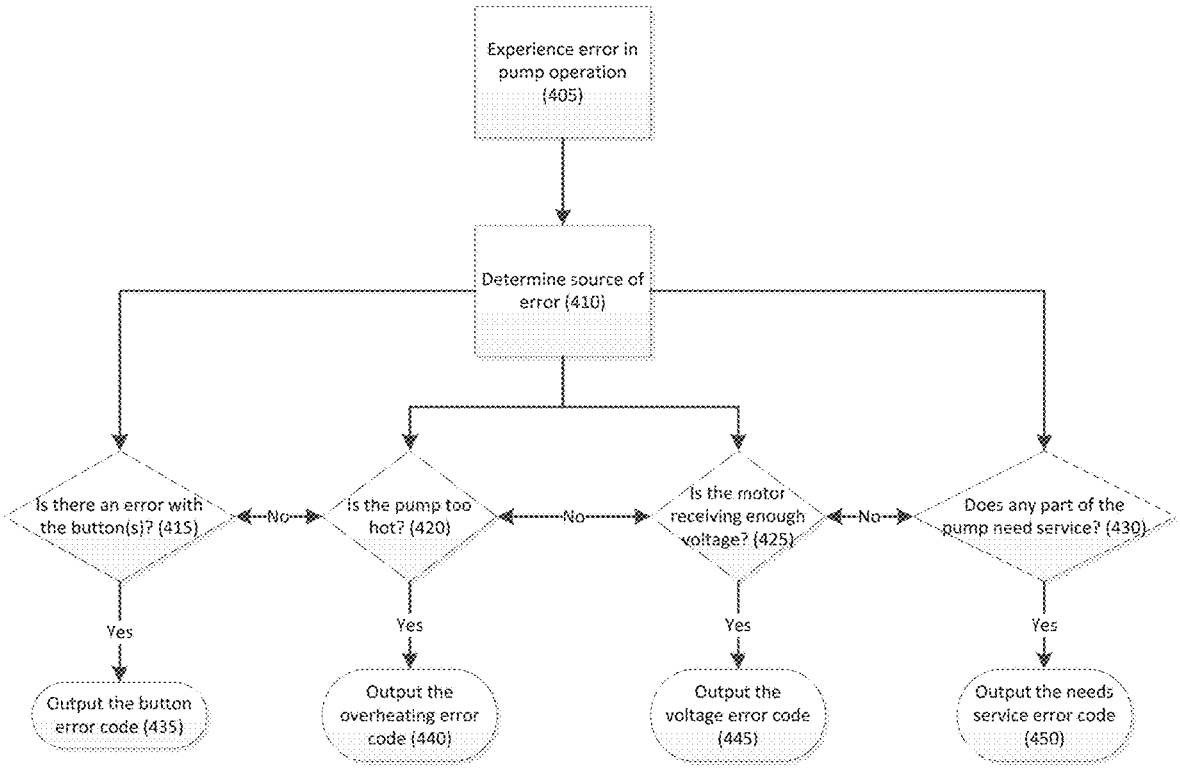
FIG. 5 is a flowchart illustrating a method of identifying an error and outputting an error code.

As shown in FIG. 5, the feedback devices (e.g., output from the LED 295 and/or the haptic motor 306) alert the user when an error occurs (405). The controller 100 (FIG. 10) determines what type of error occurred (410) in the hydraulic power system 10. The feedback devices can then alert the user to as to which type of error occurred.

Figure 10:
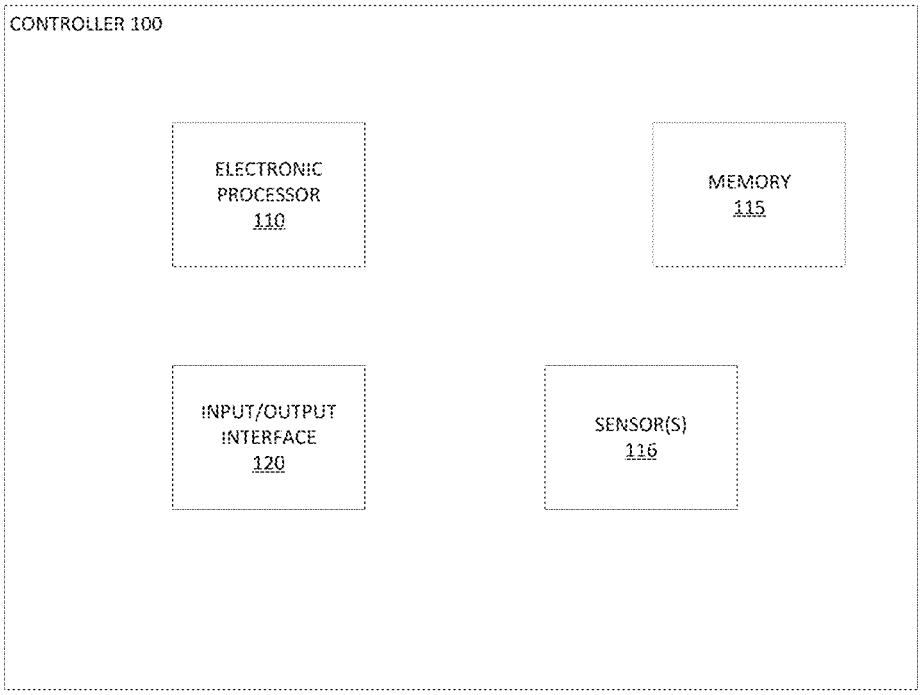
FIG. 10 is a block diagram illustrating the controller 100 configured to implement the methods of FIGS. 5-8*a* and 9*a*-9*b*.

As illustrated in FIG. 10, the controller 100 includes an electronic processor 110, a memory 115, and an input/output interface 120. The illustrated components, along with other various modules and components are coupled to each other by or through one or more connections that enable communication therebetween. The connections may include control or data buses. The use of control and data buses for the interconnection between and exchange of information among the various modules and components would be apparent to a person skilled in the art in view of the description provided herein. It should be understood that some or all components and/or functionality of the controller 100 may be dispersed over a single or multiple devices (for example, the pendant 66 and/or the system 10). It should also be understood that the methods described below are performed by the hydraulic power system 10, more particularly the controller 100.

The electronic processor 110 is configured to obtain and provide information (for example, from memory 115 and or the input/output interface 120), and process the information by, for example, executing one or more software instructions or modules, capable of being stored, for example, in a random access memory ("RAM") area of the memory 115 or a read only memory ("ROM") of the memory 115 or another non-transitory computer readable medium (not shown). The software can include firmware, one or more applications, program data, filters, rules, one or more program modules, and other executable instructions. The electronic processor 110 is configured to retrieve, from the memory 115, and execute, among other things, software related to the control processes and methods described herein. The memory 115 can include one or more non-transitory computer-readable media, and includes a program storage area and a data storage area. The program storage area and the data storage area can include combinations of different types of memory, as described herein. The electronic processor 110 may also include hardware capable of performing all or part of processes described herein.

The input/output interface 120 is configured to receive input and to provide system output. The input/output interface 120 obtains information and signals from, and provides information and signals to, (for example, over one or more wired and/or wireless connections) devices both internal and external to the system 10 and pendant 66 (for example, haptic motor 306, buttons 182*a*, 182*b*, 182*c*, motor 18, and the like). The controller 100 includes one or more sensors 116, each of which is configured to measure/detect one or more characteristics of one or more components of the hydraulic power system. Such sensors 116 include voltage sensors, current sensors, power sensors, temperature sensors/switches, pressure sensors/switches, and the like. Each of the sensors 116 are distributed throughout the hydraulic power system 10.

The controller 100 is configured to monitor the system 10 for and detect one or more types of errors. Such errors include, for example, as illustrated in FIG. 5, an error in one or more buttons, an overheat error, a low/high voltage error, or an error due to one or more components of the pump requiring service. A button error (415) may occur when a button 182A, 182B, 182C is stuck on (for example, stuck in an actuated position/cannot be returned to its normal position), or when a button 182A, 182B, 182C is actuated while power is being applied to the hydraulic power system 10. An overheat error (420) may occur on or more components of the system 10 exceed a particular temperature threshold. For example, an overheat error occurs when a fluid temperature switch (not shown) of the system 10 is in an open position; when an ambient temperature sensor (of the sensors 116) measures an ambient temperature above an ambient temperature threshold; when a temperature of a microprocessor control unit (MCU) (for example, in some embodiments, the controller 100) exceeds a MCU threshold; when a temperature of a motor bridge (not shown) is above a motor bridge temperature threshold. In the illustrated embodiment, the ambient temperature sensor is disposed proximate the MCU so that a temperature measured by the ambient temperature sensor is approximately equivalent to a temperature of the MCU. A low/high voltage error (425) occurs when a voltage measured at one or more locations within the system 10. The low/high voltage error may be, for example, a voltage measured at a motor controller (for example, in some embodiments, the controller 100) is below or above a voltage threshold. In some embodiments, as explained in more detail below, the low/high voltage error is determined following analyzing start-up conditions and detecting whether any dirty generator voltage is present. A service error (430) is when one or more components of the hydraulic power system 10 (e.g., the motor 18, valves 21, valve 50, fan 310, etc.) malfunctions and needs to be repaired or replaced.

FIG. 11 is a block diagram of the hydraulic power system 10 in accordance to some embodiments. As illustrated, the system 10 operates a connected hydraulic torque wrench 950. The torque wrench 950, as explained in more detail below, is driven via the pump 22 which supplies hydraulic fluid under pressure through one or more flow control valves 21. The system further includes a pressure relief valve(s) 50 to prevent pressure in one or more of the fluid lines from exceeding a preset limit. The valves 21, valve 50, motor 18, fan 310, sensors 166 are communicatively coupled (not shown) to the controller 100.

Each type of error corresponds to a unique error code. Each of the error types may correspond with a unique LED 295 and/or haptic motor 306 output in order to alert the user to the specific error (435, 440, 445, and 450 respectively). In the illustrated embodiment, the haptic motor 306 provides a uniform vibrational output for each type of error, and is intended to alert the user that an error is present. The LED 295 outputs different patterns of light (e.g., combinations of short and long blinks) and/or different colors of light. In the illustrated embodiment, the haptic motor 306 outputs three cycles of a vibration pattern before stopping, while the LED 295 outputs a continuous light pattern until the error is cleared. In other embodiments, the controller 100 is configured to operate the LED 295 and the haptic motor 306 to continue to output light and vibrations respectively until the error is remedied or cleared. Additionally, the motor 18 is disabled during each of an overheat error and a low voltage error, while both the motor 18 and the valves are disabled during each of a button error and a service error. The fan 310 may be enabled in the event of an overheat temperature condition, in order to assist in clearing an overheat error 420.

After observing error codes, a user (or service technician) may be able to determine specifically how to address the problem. For example, observing a button error (435) may alert a user that the button 182B should be released, or that a switch 302 is faulty and needs to be replaced. An overheat error (440) alerts a user that the hydraulic power system 10 should be allowed to cool down. A low/high voltage error (445) alerts a user of an issue in supplying sufficient electrical power to the hydraulic power system 10. The service error (450), on the other hand, alerts the user that one or more components of the hydraulic power system 10 should be investigated, and possibly repaired. The service error may or may not provide more particular information regarding a specific component that should be serviced.

Figure 6:
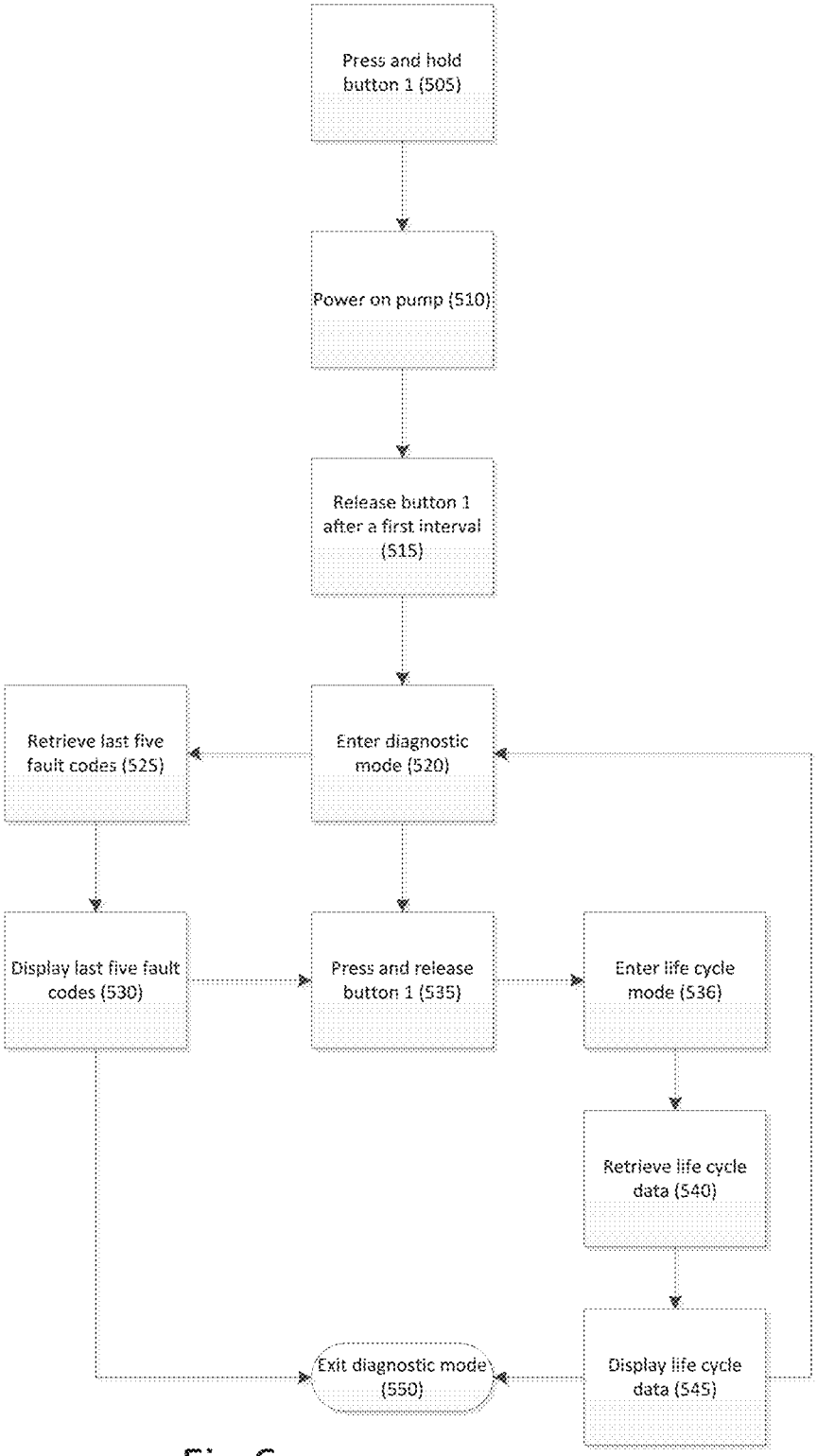
FIG. 6 is a flowchart illustrating a method of accessing diagnostic information of a hydraulic power system.

As shown in FIG. 6, a user may enter (via the controller 100) a diagnostic mode of the hydraulic power system 10 (specifically, the controller 100) (FIG. 1) and monitor or observe system errors that the hydraulic power system 10 has experienced. In the diagnostic mode, the controller 100 is configured to display (for example, via a display (not shown)) more detailed information than the error codes to assist a user in identifying components and/or operational characteristics that triggered a service error (450). For example, while in the diagnostic mode, the user may identify a potential issue with the motor 18. A user may actuate (e.g., press and hold) a first button 182A (510) of the pendant 66 while the hydraulic power system 10 powers on (505) (e.g., following being connected to a power supply) and then release the first button 182A after a first predetermined time interval (for example, at least five seconds) (515). The user may be alerted via vibrations produced from the haptic motor 306 (via controller 100) that the first predetermined time interval has elapsed.

The hydraulic power system 10 then enters diagnostic mode (520), from which the controller 66 can retrieve past system errors and present them to the user of the pendant 66. In the illustrated embodiment, the hydraulic power system 10 retrieves one or more of the previous system errors (525) while in the diagnostic mode (520). The controller 100 is configured to operate feedback devices on the pendant 66 communicate the errors, for example, starting from the most recent (530). In the illustrated embodiment, the pendant 66 outputs all error codes via the LED 295. Each error code, for example, has a unique combination of blinks (e.g., long blinks and short blinks). In the illustrated embodiment, the LED 295 emits a short blink in red light, and the LED 295 emits a long blink in green light. In the illustrated embodiment, long blinks may be approximately three times the duration of short blinks. In the illustrated embodiment, the controller 100 is configured to perform a delay sequence between each error code to assist a user in differentiating each error code. For example, the delay sequence consists of a predetermined series of blinks from the LED 295 in a different color (e.g., yellow light). After observing the five error codes, a user (or service technician) can decide how to service the hydraulic power system 10. The hydraulic power system 10 (controller 100) may then exit diagnostic mode by performing a power cycle (e.g., by completely powering off the hydraulic power system 10, and then restoring power to the hydraulic power system). The hydraulic power system 10 then returns to an operating mode (550). The power cycle can be performed by unplugging and replugging an electrical cord, by removing and recoupling a battery, or other similar means.

Alternatively (or in addition to displaying the past system errors (530)), the pendant 66 may be configured to display life cycle data for the hydraulic power system 10. For example, while the hydraulic power system 10 is in diagnostic mode (520), the user can hold the first button 182A (535) until the hydraulic power system 10 enters life cycle mode (536). Once in life cycle mode, the hydraulic power system 10 (controller 100) retrieves life cycle data for the hydraulic power system 10 (540). In some embodiments, the life cycle data consists of a number of actuation cycles of a valve, a total run time of the motor 18 (FIG. 3A) (for example, in hours), a number of times that the motor 18 has started within a given time period, a damage/service life predictor, and a firmware version. In other embodiments, additional life cycle information may be provided.

For example, the controller 100 may operate the LED 295 to output a series of blinks to communicate the life cycle information (545). In the illustrated embodiment, the LED 295 displays the number of actuation cycles of a valve, the total run time of the motor 18 (FIG. 3A), and the number of times the motor 18 has started in scientific notation. For each of these values, the LED 295 outputs between one and nine blinks in a first color (e.g., red), followed by a series of blinks (e.g., between one and nine blinks) in a second color (e.g., green). The number of blinks in the first color equates to a value of a first integer A, and the number of blinks in the second color equates to a value of a second integer B. Using the form $Y=A*10^B$, the first integer A corresponds to the coefficient, and the second integer B corresponds to the exponent. A user takes the two integer values, and using the scientific notation form, determines the number of cycles Y. In the illustrated embodiment, the first integer value (i.e., the coefficient A) is rounded up to the nearest integer (e.g., if the motor 18 has run for 410 hours, the LED 295 would blink five times in the first color).

The LED 295 also outputs a series of blinks to communicate the current version of firmware running on the hydraulic power system 10 (545). The LED 295 outputs a series of blinks (e.g., between zero and nine) in the second color, followed by a series of blinks (e.g., between one and nine blinks) in the first color. The number of blinks in the second color equates to a value of a third integer C, and the number of blinks in the first color equates to a value of a fourth integer D. Using the form Z=10C+D, the user can determine the current version of firmware, numbered between 1 and 99.

The damage/service life predictor is used to estimate when the hydraulic power system 10 will experience catastrophic failure. In the illustrated embodiment, the hydraulic power system 10 uses Miner's Rule by to predict when failure will occur by assigning weighted values to specific pressure ranges that the hydraulic power system 10 may experience. The hydraulic power system 10 (controller 100) records the number of times each range is reached, and through Miner's Rule, calculates the when a critical value (i.e., potential failure) occurs. The controller 100 may then output, via LED 295 and/or haptic motor 306, a predictor sequence to alert the user that the hydraulic power system should be serviced or replaced before failure occurs.

In the illustrated embodiment, the controller 100 is configured to perform a delay sequence between each life cycle value. For example, the delay sequence is a series of blinks in a third color (e.g., yellow). After all life cycle information is displayed, the hydraulic power system 10 (controller 100) may exit life cycle mode but remain in diagnostic mode (520), or may exit diagnostic mode altogether and return to operating mode (550) after performing a power cycle on the hydraulic power system 10.

Any data (e.g., fault codes, life cycle values, performance characteristics, etc.) collected during operation of the pump may be communicated and stored on an external drive (e.g., a flash drive, a server, etc.) and/or memory 115. The hydraulic power system 10 may transfer the data directly to the external drive connected directly to the hydraulic power system 10 or via a wired connection. Alternatively, the hydraulic power system 10 may wirelessly communicate with the external drive (e.g., via Bluetooth, WI-FI, etc.). In some embodiments, a user may access the data on the external drive without the hydraulic power system 10 present. The data may be accessed to evaluate pump performance. For example, in some embodiments, a user may access the complete cycle for applying torque to a bolted joint to identify whether the operation was performed as intended or if any irregular characteristics were present. Also, in some embodiments, the user and/or the pump control system may access archived performance data from previous operations of the pump to better control or optimize the performance of the pump when the pump is used for a similar operation.

The controller 100 operates the hydraulic power system 10 (FIG. 1) normally for various applications after performing a power cycle to exit diagnostic mode. For example, the hydraulic power system 10 may be connected to a hydraulic torque wrench 950 (FIG. 11) to supply pressurized hydraulic fluid to actuate the torque wrench 950 and tighten a workpiece (e.g., a nut or bolt—not shown). In some embodiments, the hydraulic torque wrench is similar to the hydraulic torque wrench described in U.S. Publication No. 2006/0053981, which is incorporated herein by reference. For example, as shown in FIG. 11, the torque wrench 950 may include an actuator such as a cylinder and piston (for example, cylinder and piston 952) for driving a socket 954 to rotate the workpiece, and the socket 954 is ratcheted so that retracting the piston 952 does not cause the socket 954 to counter-rotate. The torque wrench 950 therefore drives the socket 954 to tighten a workpiece by alternatively extending and retracting the piston 952, and the socket 954 is rotated in a single direction. The hydraulic power system 10 may provide fluid to extend the piston 952, and then relieve the pressure or drain the fluid to retract the piston 952. This process may be repeated (i.e., extending and retracting the piston 952) until the fastener is fully tightened. A user may actuate one button 182B of the pendant 66 (FIG. 2) in order to advance the torque wrench 950, and may release the button 182B of the pendant 66 in order to retract the torque wrench 950.

Figure 7:
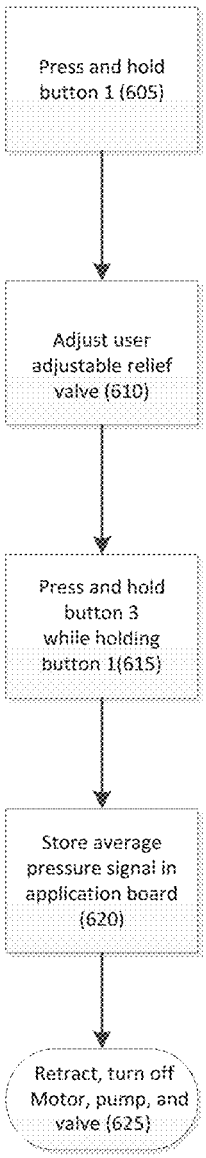
FIG. 7 is a flowchart illustrating a method of setting a set point pressure for an automatic hydraulic power system cycle operation.

As shown in FIGS. 7 and 8, the pump controller (for example, controller 100) is configured to perform an automatic (auto) cycle for operating the torque wrench 950. In the auto-cycle, the controller 100 automatically and efficiently alternates between extending and retracting the piston 952, reducing "dead" time in which the torque wrench 950 is not applying torque to the socket 954. This may limit damage to the pump components from unnecessary pressure cycles and avoid the need to repeatedly actuate the advance and retract button 182B on the pendant 66 (FIG. 2).

Figure 8A:
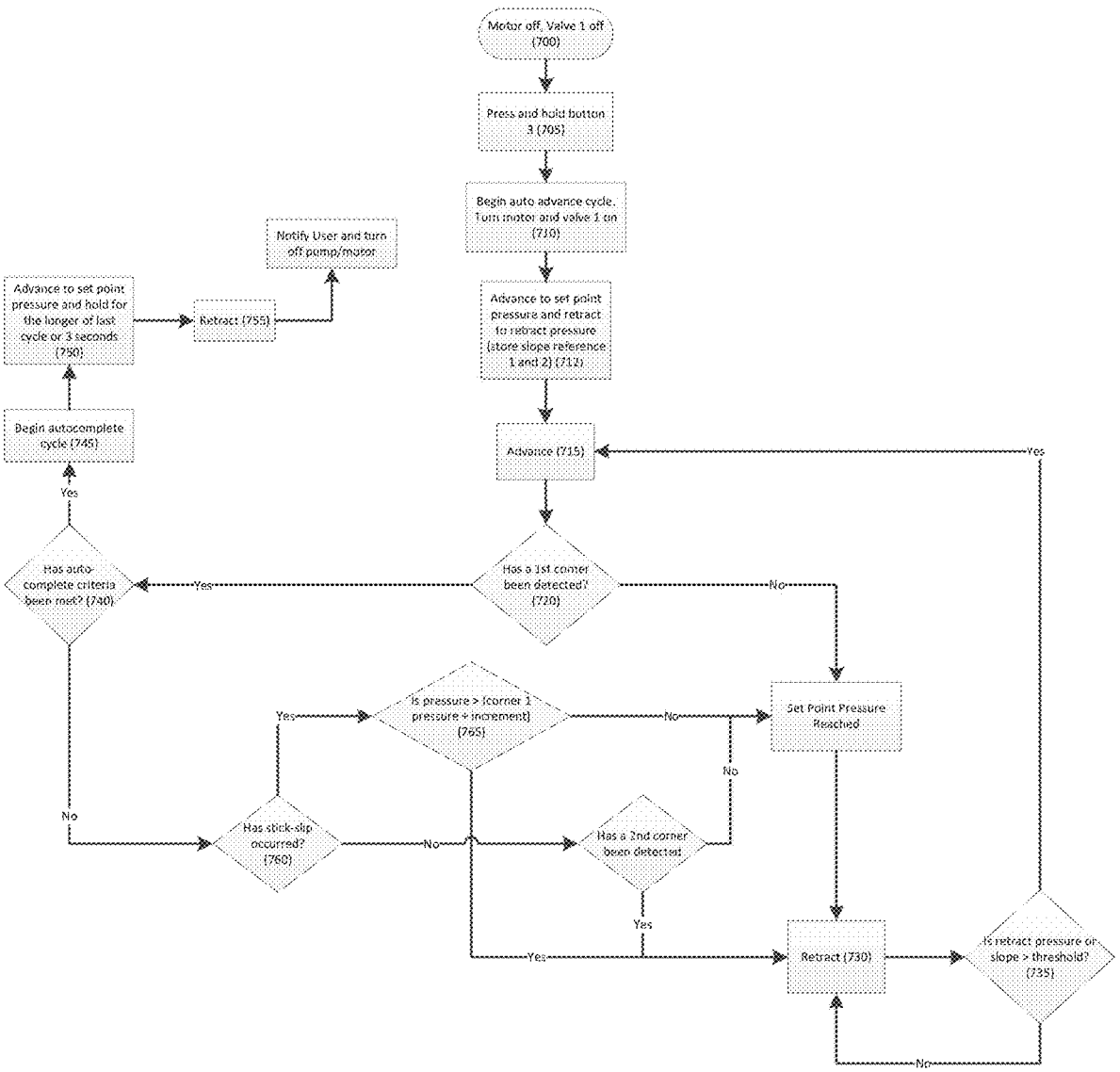
FIG. 8*a* is a flowchart illustrating a method of operating a hydraulic power system in an automatic cycle operation.
Figure 8B:
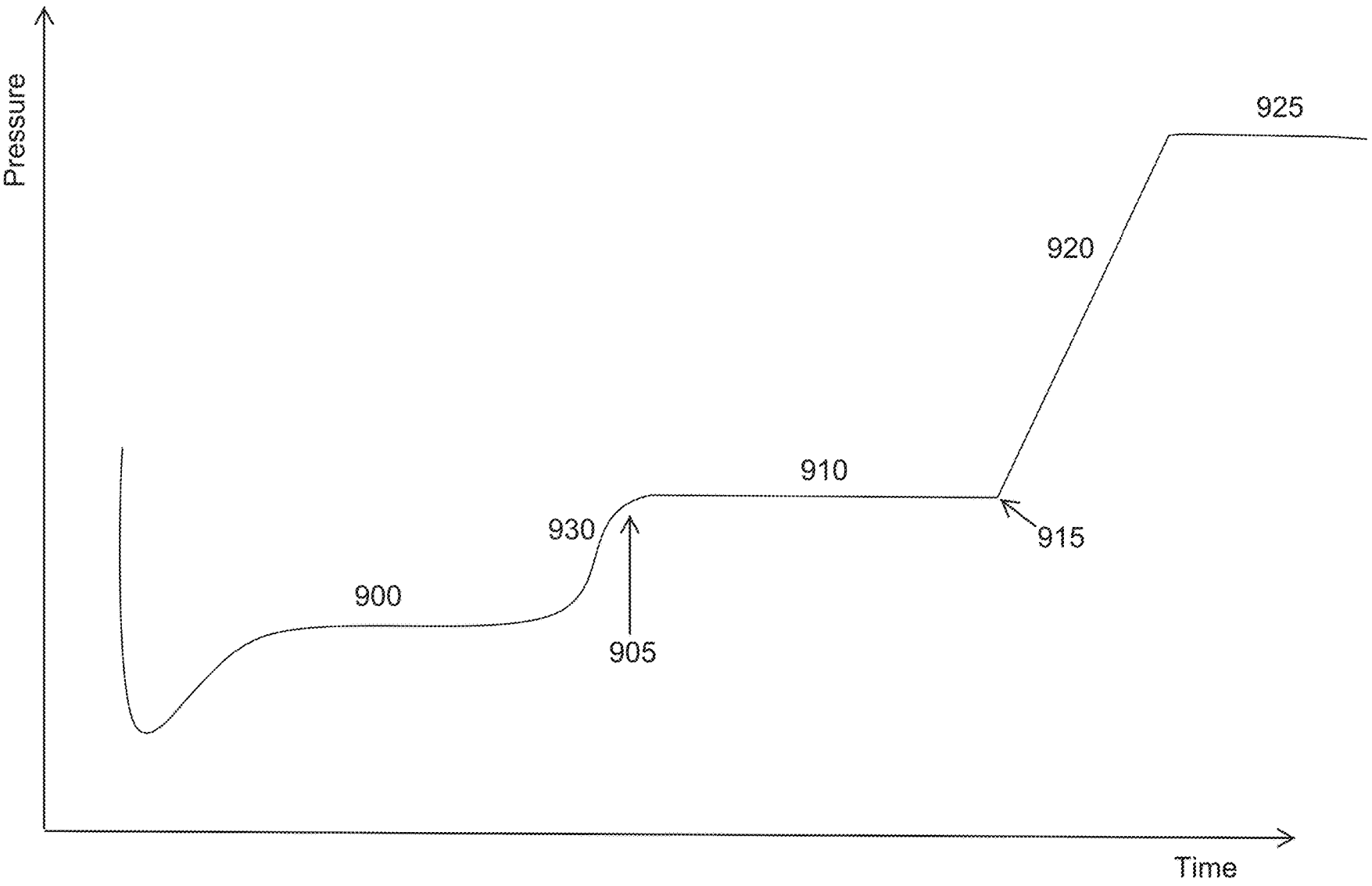
FIG. 8*b* is a graph illustrating a torquing cycle of a hydraulic power system in an automatic cycle operation.

As shown in FIG. 7, before beginning the auto-cycle, the controller 100 receives, from the user (for example, via a user interface/input such as one or more of the switches 182A, 182B, 182C), a set point pressure for the auto-cycle while setting the user relief valve (for example, valve 50). The controller 100 is configured to determine a maximum pressure at which the pump switches the valve to retract based on the set point pressure. In a conventional system, the torque wrench 950 partially tightens the fastener beginning when a pressure in the torque wrench 950 reaches a first corner or first point or first knee 905 (FIG. 8*b*) until the pressure reaches a second corner or second point or second knee 915 (FIG. 8*b*). Then, the pressure continues to increase until the maximum pressure is reached (or when the user releases the manual button 182A), although the fastener does not continue to tighten between the second knee 915 and the maximum pressure. This may waste time and energy because although the hydraulic power system 10 is powered on, no work is performed between the second knee 915 and the maximum pressure. Conserving energy may be particularly important in embodiments where the hydraulic power system 10 is battery-operated so that the greatest number of cycles may be performed in a single charge. The auto-cycle enables the torque wrench 950 to begin to retract at a pressure below the maximum pressure, thereby reducing the time between torquing cycles, improving efficiency of the hydraulic power system 10 and speeding up the tightening process of the fastener.

In the illustrated embodiment, while the hydraulic power system 10 on, the controller 100 receives, from a user of the pendant 66, an actuation of the first button 182B (605), activating the advance mode (i.e., where the torque wrench 950 advances) with both the motor and the first valve on. While the user continuously actuating the first button 182B, the user adjusts a user relief valve 50 to a desired set point pressure (i.e., the pressure that corresponds to the final torque desired by the user) (610). The controller 100 then receives, from the user, an actuation of the third button 182A of the pendant 66 (615). While both buttons 182A, 182B are actuated, a circuit board (for example, in the illustrated embodiment, controller 100) captures and stores the user adjusted set point pressure (620). The set point pressure value is stored by the controller 100 until the user clears the value or sets a new set point and overrides the first set point pressure (for example, by pressing the first and second buttons 182B, 182C to clear the value and repeating steps 600-620). In the illustrated embodiment, the LED 295 outputs the third color and the haptic motor 306 sends vibrational feedback when the set point pressure has been recorded successfully. The motor 18, pump 22, and valve also turn off (625).

After setting the set point pressure, the hydraulic power system 10 (controller 100) may initiate the auto-cycle. In some embodiments, when the user releases the button 182B, the controller 100 will remain in the auto-cycle and will operate without any further user input. In other words, the torque wrench 950 will advance and retract without the user having to press or hold the button 182B. If desired, the user may set the pendant 66 down and the hydraulic power system 10 will continue to operate the torque wrench. In other embodiments, the user may hold the a button 182A the entire time the torque wrench 950 advances and release the button 182A to allow the torque wrench 950 to retract. As shown in FIG. 8*a*, when the motor 18 is off and the first valve is closed (700), the controller 100 receives, from a user, an actuation of the third button 182A of the pendant 66 for a first period of time (for example, for approximately more than one second) or for one advance stroke (705) and, in response, turns on the motor 18 and the first valve, and begins the auto-cycle (710).

In some embodiments, during an initial advance cycle, the controller 100 advances the torque wrench 950 to the set point pressure value (712) and self-calibrates the hydraulic power system 10 for the operation. The hydraulic power system 10 thus may not require a separate calibration process that would require additional time. The controller 100 accordingly calibrates the hydraulic power system 10 "on-the-fly" while the torque wrench 950 is applying torque to the work piece during the initial advance cycle. While advancing, the application controller 100 records the pressure at regular intervals and calculates a change in pressure at a point below the set point pressure, storing the change as a first reference slope value. The first reference slope value represents a minimum change in pressure experienced by the torque wrench 950 when the piston/rod reaches its maximum stroke or "dead head." The application controller 100 also calculates and stores a second reference slope value, which is calculated based off of the first reference slope value (e.g., the second reference slope value may be calculated as a percentage of the first reference slope value). In the illustrated embodiment, the second reference slope value is less than the first reference slope value.

As shown in FIGS. 8*a* and 8*b*, during the first portion of the auto-cycle, pressurized hydraulic fluid is supplied to the piston. Initially, at a start 900 of a torquing cycle, the pressure in the wrench 950 may remain low until any ratchet backlash (sometimes referred to as "slop") and socket clearance are overcome. Also, when the work piece or nut is loose, the actuator of the torque wrench 950 may exhibit a sharp increase in pressure when piston/rod reaches its maximum stroke (or dead head). In the illustrated embodiment, the pressure level exhibits a first inflection point or knee 905. The controller 100 detects the first knee 905 at a point where a change in pressure per unit time (that is, a slope) changes from being significantly greater than the first reference slope value to less than the first reference slope value (occurring at a pressure greater than the slop pressure).

In some cases, the pressure in the actuator 952 rapidly increases during a beginning stage 930 before the first knee 905. In the illustrated embodiment, when the wrench 950 begins applying torque under load, the pressure increases at a slower rate during an advancing stage 910 than during the period immediately before the first knee 905. During the advancing stage 910, the wrench 950 is applying torque to the socket 954 under load (e.g., to tighten a nut). The pressure reaches a second inflection point or second knee 915 after which the pressure increases rapidly (i.e., exhibits a steep slope) during a dead head stage 920. The controller 100 detects the second knee 915 at a point where the slope changes from being less than the second reference slope value to greater than the first reference slope value. In some embodiments, the controller 100 requires that a minimum time interval must elapse between the first knee 905 and the second knee 915. The rapid increase in pressure indicates that the torque wrench 950 has reached its maximum stroke and cannot advance any further.

The controller 100 measures the pressure of the fluid supplied to the torque wrench, as well as the slope (that is, the change in pressure over time), and the change in slope over time, to determine whether the system 10 has encountered the second knee 915. The second knee 915 is a transition between the advancing stage 910 and the dead head stage 920, and the slope is significantly (for example, approximately ten times) greater during the dead head stage 920 than during the advancing stage 910. The hydraulic power system 10 continues supplying hydraulic fluid to the torque wrench 950 until the controller 100 detects the second knee 915 (e.g., when the slope and change in slope exceed predetermined threshold values), and then retracts the torque wrench. In the some embodiments, when the second knee 915 is detected, the controller 100 stores a new second reference slope value based on the slope detected near the second corner. To prevent a false detection of a corner, the controller 100 may be configured to compare the detected second knee value to the first knee value. When the second knee value exceeds the first knee value, the second knee value is stored as a new second reference slope value. Otherwise, when the second knee value fails to exceed the first knee value, the detected second knee value is not stored.

When the controller 100 does not detect a second knee (for example, if a second knee was encountered, but the controller 100 did not identify it because a minimum time interval did not elapse), the hydraulic power system 10 supplies hydraulic fluid to the drive actuator of the torque wrench 950 until the pressure is within a predetermined threshold of the set point pressure 925 (i.e., the user-defined maximum pressure). Then the hydraulic power system 10 returns the oil from the torque wrench 950 to the reservoir, automatically retracting the torque wrench 950 (730) or permitting the torque wrench 950 to retract. In either case, whether the controller 100 determines the presence of a second knee or it does not, the piston 952 in the torque wrench 950 will begin to retract before the pressure reaches the set point pressure 925. The actuator retracts to its initial or retracted position, at which point the process is repeated. After the pressure passes a first threshold (an initial pressure or reset pressure—for example, approximately 2000 psi) (735) and the pressure in the torque wrench 950 actuator has reached a predetermined level, the fluid again advances the torque wrench 950 (715). The process of automatically advancing and retracting the torque wrench 950 continues in this manner to increase the torque applied on the work piece. In some embodiments, the above method may be applied similarly during retraction of the torque wrench 950 actuator.

Figure 8C:
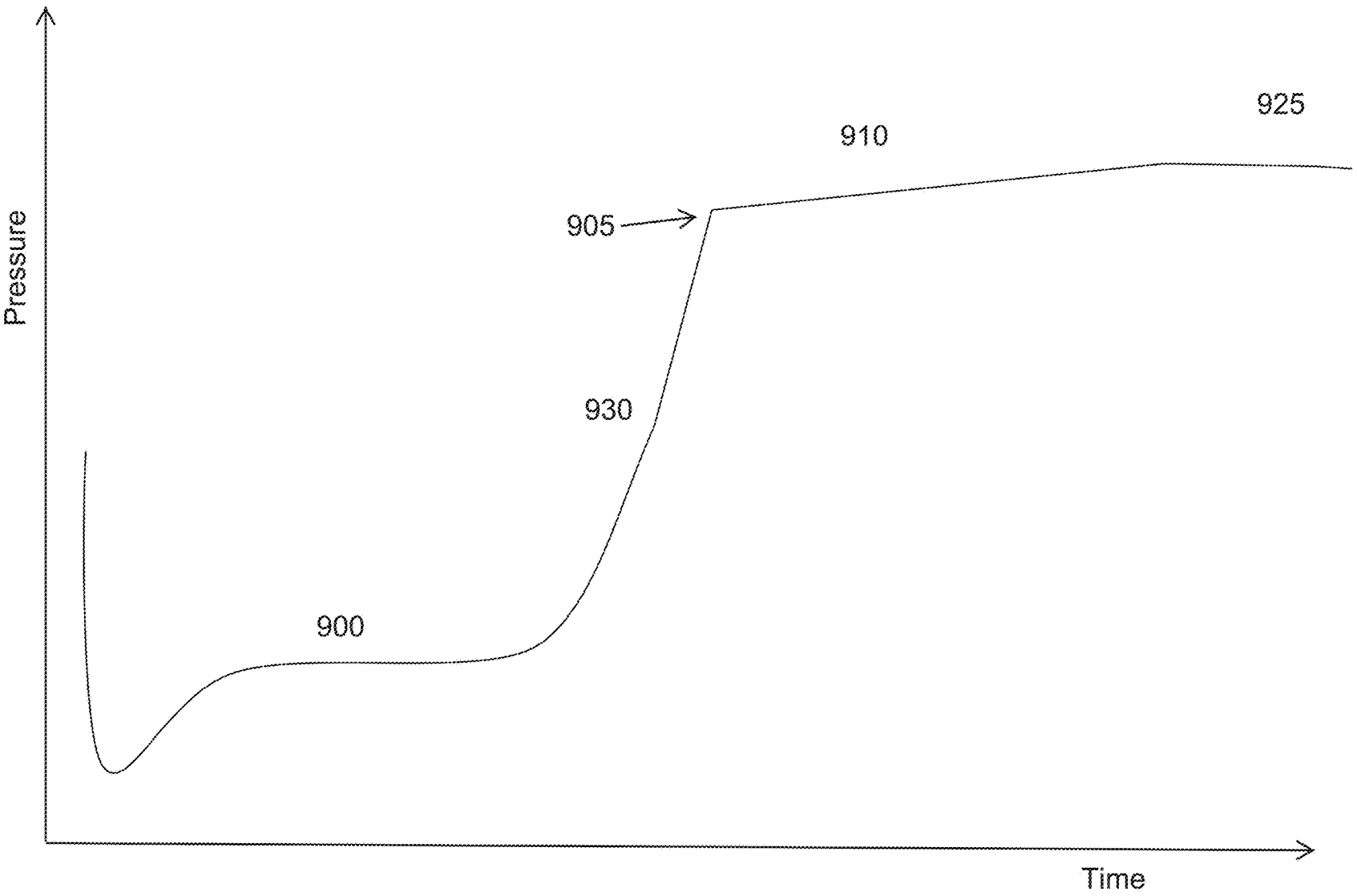
FIG. 8*c* is a graph illustrating a penultimate torquing cycle of a hydraulic power system in an automatic cycle operation.

As the desired torque is approached, the controller 100 may not detect a second knee (915). As shown in FIGS. 8*a* and 8*c*, when the work piece is close to the desired torque, the pressure in the piston 952 at the advancing stage 910 approaches the set point pressure 925. Stated another way, the slope and change in slope are relatively low because the pressure is close to reaching the set point pressure 925 (i.e., the pressure of the relief valve 50). If no second knee is detected (i.e., because the slope and change in slope of pressure versus time does not exceed the thresholds before the wrench 950 actuator reaches the set pressure), and an auto-complete criteria is met, the hydraulic power system 10 (controller 100) will begin an auto-complete cycle (745).

Figure 8D:
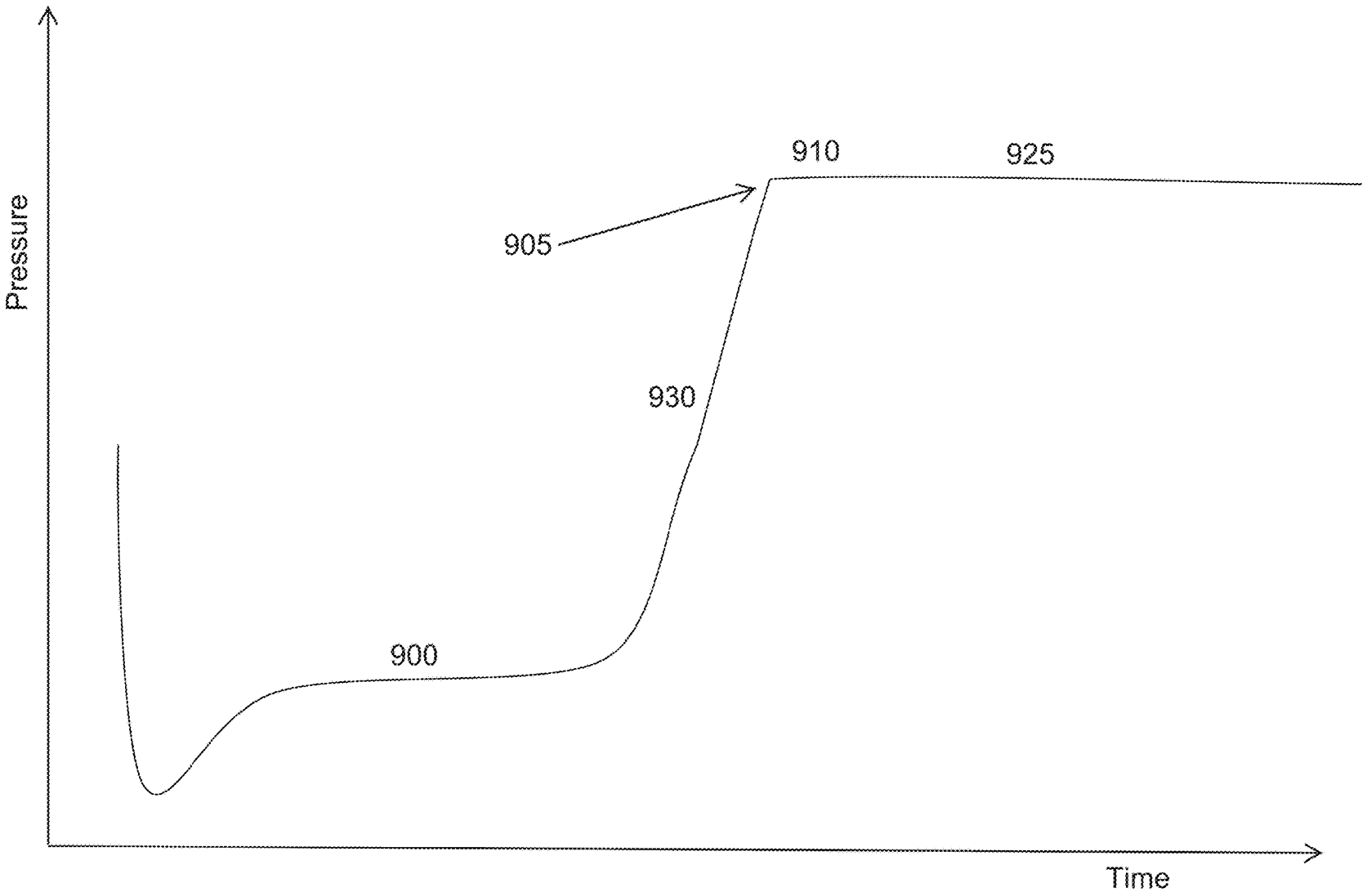
FIG. 8*d* is a graph illustrating a final torquing cycle of a hydraulic power system in an automatic cycle operation.
Figure 8E:
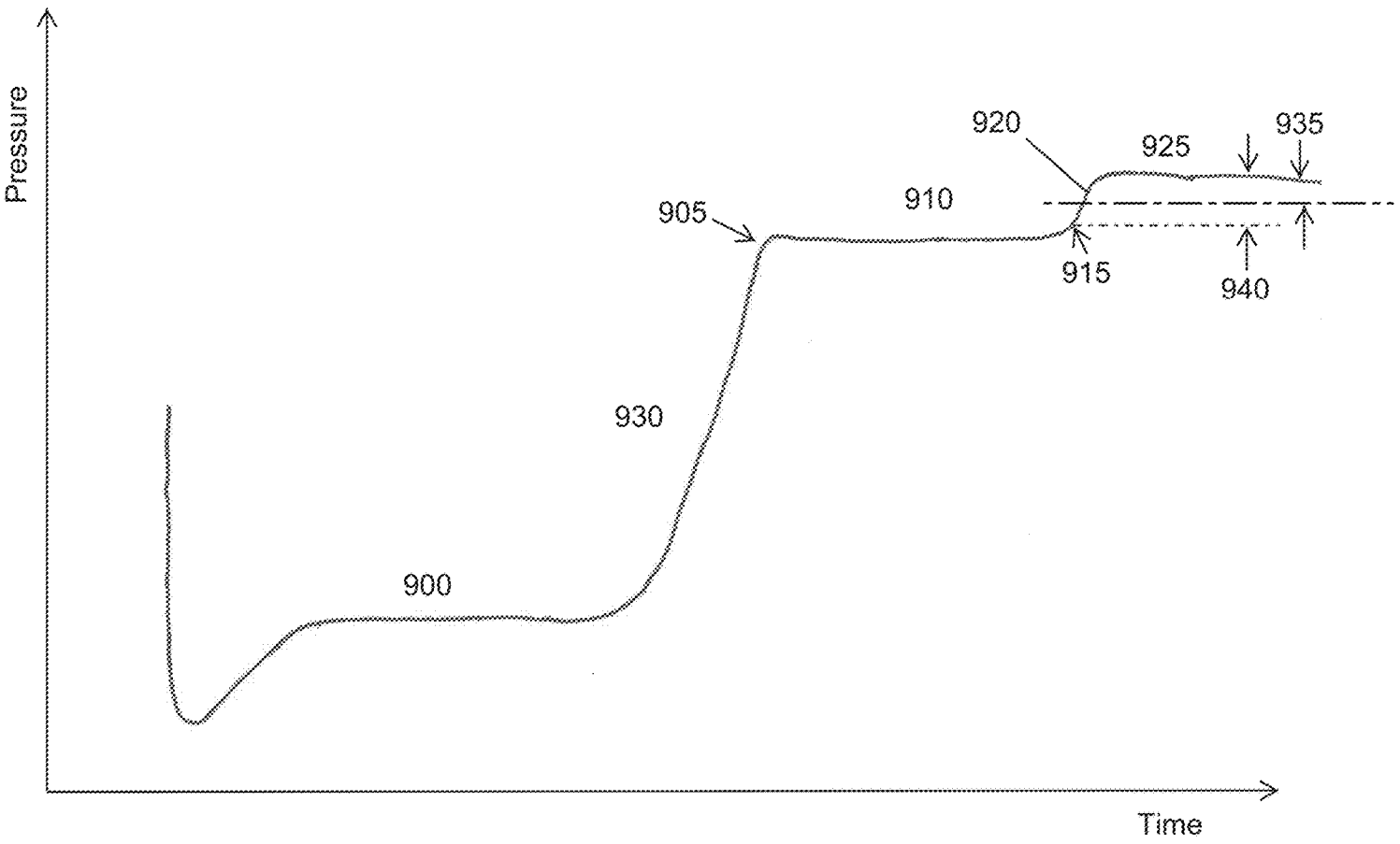
FIG. 8*e* is a graph illustrating a penultimate torquing cycle of the hydraulic power system in an automatic cycle operation occurring under a different condition than the torquing cycle of FIG. 8*c*.

In the illustrated embodiment, the auto-complete criteria can be satisfied in at least one of two ways. First, as shown in FIG. 8*d*, the auto-complete criteria may be satisfied if, after the first knee 905, the measured slope is less than the second reference slope value and the measured pressure is sufficiently close to the set point pressure 925 (e.g., a difference between the measured pressure and the set point pressure 925 is below a predetermined threshold). In some embodiments, this criteria may be satisfied when pressure reaches the set point pressure 925 near the end of a cycle. To evaluate the second criteria (FIG. 8*e*), which may be more likely satisfied when the pressure during torquing reaches the set point pressure 925 at an earlier point in the cycle because the pressure was not sufficiently close 935 to the set point pressure on the previous cycle, the controller 100 calculates and stores the difference between the pressure 940 just before the second knee 915 occurs and the set point pressure 925 at the end of a cycle. When the pressure just before the second knee 915 is sufficiently close to the set point pressure 925 (e.g., the difference between the two values is below a predetermined threshold), on the subsequent cycle, the controller 100 is configured to check the difference between the set point pressure 925 and the measured pressure after a first knee 905 is reached. When the values are sufficiently close (e.g., lower than a predetermined threshold), the auto-complete criteria is satisfied.

During the auto-complete cycle, the hydraulic power system 10 (controller 100) will retract the torque wrench 950 and perform one (or two) more cycle/cycles (i.e., a final cycle) of advancing (750) and retracting (755) the torque wrench 950 to ensure that fastener is tightened to the desired torque based on pressure. In the final cycle (FIG. 8*d*), the initial stage 930 of pressure increase is reached more rapidly than the beginning stage 930 during other cycles of the torquing cycle (e.g., FIG. 8*b*), and the pressure increases to the set point pressure 925. The advancing stage 910 may be approximately identical to the set point pressure 925 in the final cycle because the nut is fully tightened. In some embodiments, the motor (18) turns off after a set time interval (or, in some embodiments, the total time of the previous cycle, whichever is longer) (for example, approximately three seconds) (700) after completing the final cycle.

In some embodiments, when the relief valve 50 is adjusted during the course of the auto-cycle so that the valve pressure is less than the initial set point pressure, the auto-cycle may be inhibited from operating properly and reaching the retracting stage (755) because neither the slope nor the change in slope will be steep enough, nor will the pressure be within the threshold of the set point pressure. After a predetermined period of time, when the difference between the pressure and the set point pressure exceeds a predetermined threshold, and the change in pressure fails to exceed a predetermined threshold, the auto-cycle terminates and the hydraulic power system 10 encounters a pressure fault. The pressure fault causes the pump 22 to turn off, and the set point pressure to reset, thereby disabling the first button 182B. The user may reset the set point pressure in order to have the controller 100/system 10 resume using the auto-cycle. In some embodiments, the user may be prevented from initiating auto-cycling when the set point pressure exceeds the maximum valve pressure.

If the torque wrench/system 10 is being operated manually (i.e., by holding down the button 182A and not using the auto-cycle), the controller 100 utilizes the LED 295 and/or haptic motor 306 to alert the user upon reaching the set point pressure. The torque wrench 950 may also alert the user upon reaching a second knee so that the user knows to retract the torque wrench. The controller 100 reduces the speed of the motor 18 after reaching the set point pressure (e.g., in either manually operation or the auto-cycle) to minimize heat generation when the torque wrench/system 10 goes over the relief valve 50 and no additional work is being performed.

Referring again to FIG. 8A, in the illustrated embodiment, the controller 100 is capable of accounting for potential stick-slip conditions (760). Following the controller 100 detecting a first knee, it may be possible that the controller 100 detects a false second knee, for example, due to stick-slip conditions. A stick-slip condition is defined as a spontaneous jerking motion that can occur while two objects are sliding over each other due to, for example, corrosion, poor lubrication, or high forces. To prevent false second knee detection, the controller 100 may be configured to, following detection of the first knee, wait a predetermined amount of time before monitoring for a negative slope and a predetermined change in slope over time (for example, greater than 4000 P"). The controller 100 then changes the pressure at which the valve 21 shifts—for example, the controller 100 may increase the pressure by a predetermined increment above the pressure at the first knee (765). In some embodiments, the increment is approximately 1200 psi.

In some embodiments, any data from the auto-cycle (e.g., previous set point pressure, recorded deadhead slopes, calculated torquing slopes, DC rail voltage of a motor controller—for example, controller 100, previous pressure differentials, etc.) collected during operation of the hydraulic power system 10 may be transmitted to and stored in a memory (for example, memory 115), which may include an onboard memory or an external memory. In some embodiments, the data in the memory 115 can be accessed by a user without the hydraulic power system 10 present.

Figure 3B:
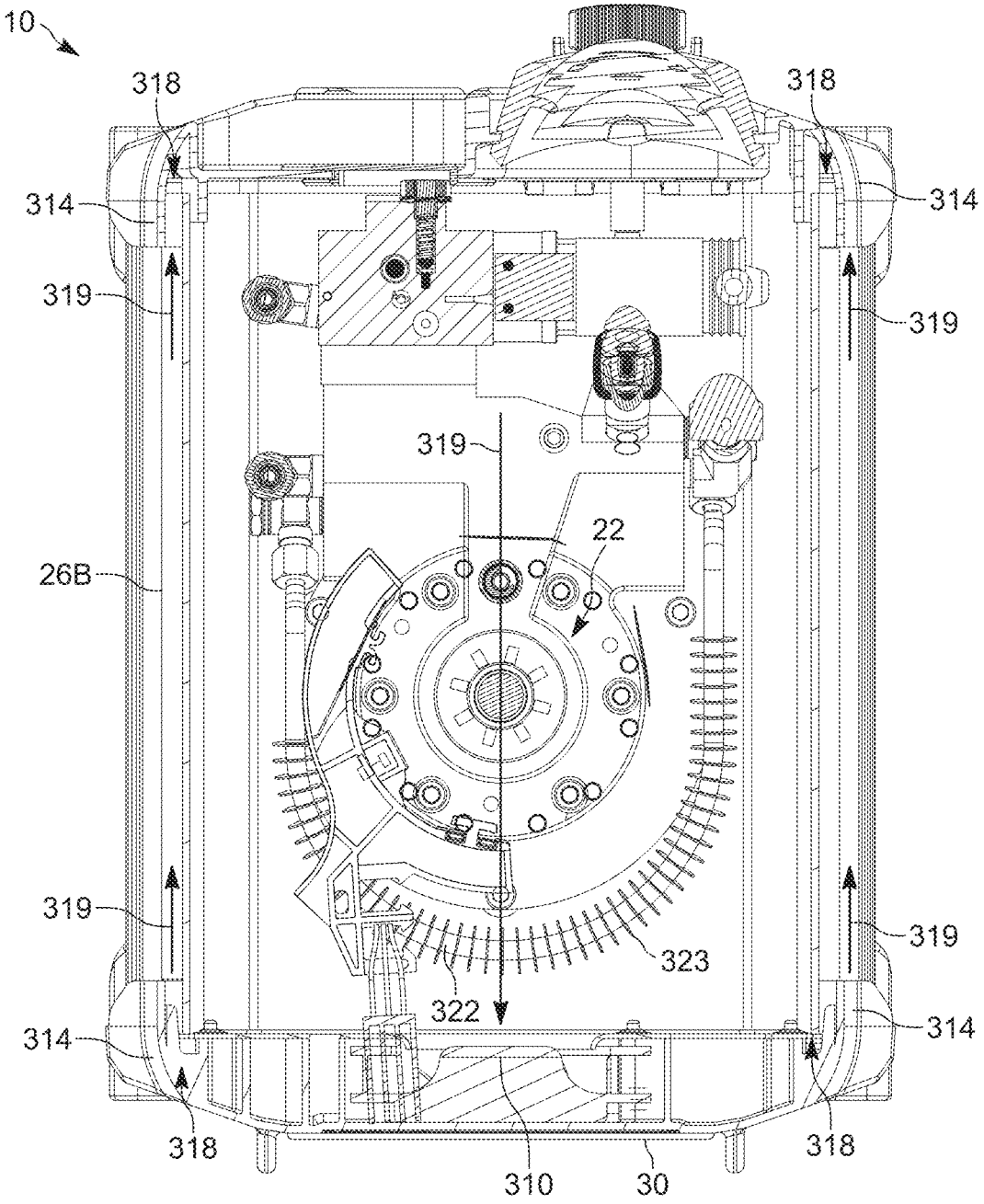
FIG. 3B is a cross-sectional view of the hydraulic power system shown in FIG. 1 viewed along section 3B-3B.
Figure 4:
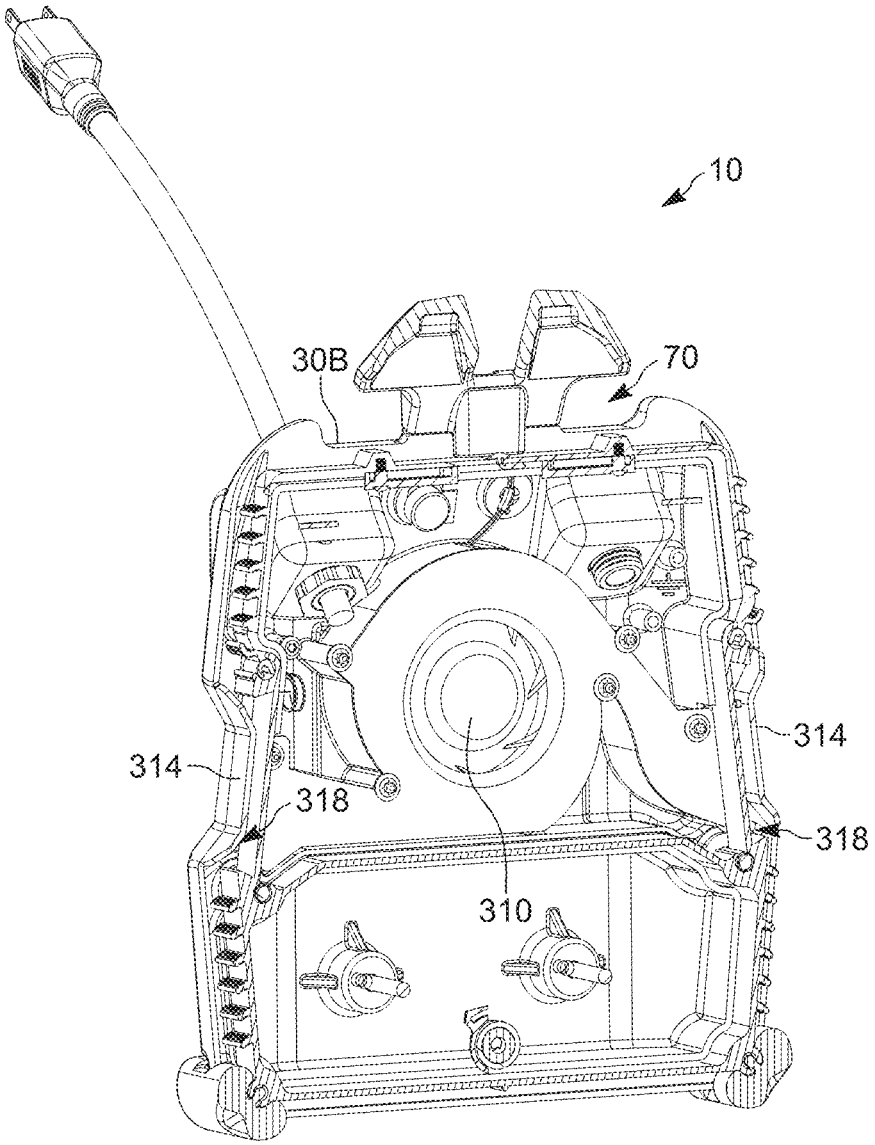
FIG. 4 is a cross-sectional view of the hydraulic power system shown in FIG. 1 viewed along section 4-4.

The hydraulic power system 10 may be used to operate a torque wrench 950 in low torque applications or high torque applications. In some circumstances (particularly in high torque applications), the hydraulic power system 10 may generate a substantial amount of heat and require cooling to maintain optimal operating conditions. FIGS. 3 and 4 illustrate the radial fan 310 positioned proximate an end cap 30 of the frame 14 (FIG. 1). As shown in FIGS. 3 and 4, a first or frontend cap 30A of the frame 14 and the second or rear end cap 30B each includes curved portions 314 that protrude beyond the outer side surfaces of a support frame 26 when the front end cap 30A and the rear end cap 30B are coupled to the support frame 26. In the illustrated embodiment, each of the end caps 30A, 30B include a first curved portion 314 proximate a first side of the support frame 26 and a second curved portion 314 proximate a second side of the support frame 26. In other embodiments, each end cap 30A, 30B may only include one curved portion 314. As illustrated in FIG. 3B, the curved portions 314 are spaced apart from the support frame 26 so that a gap 318 exists between the curved portion 314 and the support frame 26. One curved portion 314 extends over each of the gaps 318 on the support frame 26, and allows air flow to pass from within the hydraulic power system 10 to an external environment, or vice versa.

When the hydraulic power system 10 gets too hot, the controller 100 may activate the fan 310 in order to cool the hydraulic power system 10. The air flow is pulled across the motor assembly 18 and the pump 22 and through the fan 310. The movement of the air 319 across the motor assembly 18 and the pump 22 lowers a motor temperature and a pump temperature through forced convection. Heat is transferred from the surface of the motor assembly 18, from the pump 22B, and/or from heat fins 323 of a heat exchanger 323 to the air 319, thereby reducing the temperature of the motor assembly 18, the pump 22, the pressurized fluid, and/or other internal components such as electronic controllers/processors (for example, some or all of controller 100). The air 319 passes through the compartment of the frame assembly 14 and is exhausted through the outlet gaps 318 proximate the radial fan 310 and back into the external environment over cooling fins (not shown) outside the reservoir.

When the hydraulic power system 10 initially turns on, the fan 310 is off (800). As the hydraulic power system 10 runs, the controller 100 monitors, via the one or more sensors 116, a plurality of values of the system 10. Such values may include, for example, an ambient temperature (805), a motor controller (in some embodiments, the controller 100) bridge temperature (810), and a position of an oil temperature switch (e.g., which corresponds to a temperature of the fluid, such as oil or other hydraulic fluid) (806). The controller 100 stores the values (813) in order to compare the measured values against threshold values. The controller 100 may also use one or more of the sensors 116 to monitor a state of the motor 18 (e.g., an on state or an off state) (807). The controller 100 may activate the fan 310 in either a first mode (e.g., powering the fan 310 based on the motor 18) (830) or in a second mode (e.g., powering the fan 310 continuously, irrespective of the motor 18) (855) in response to the measured values exceeding the threshold values (805, 806, 807, and 810 respectively).

Figure 9A:
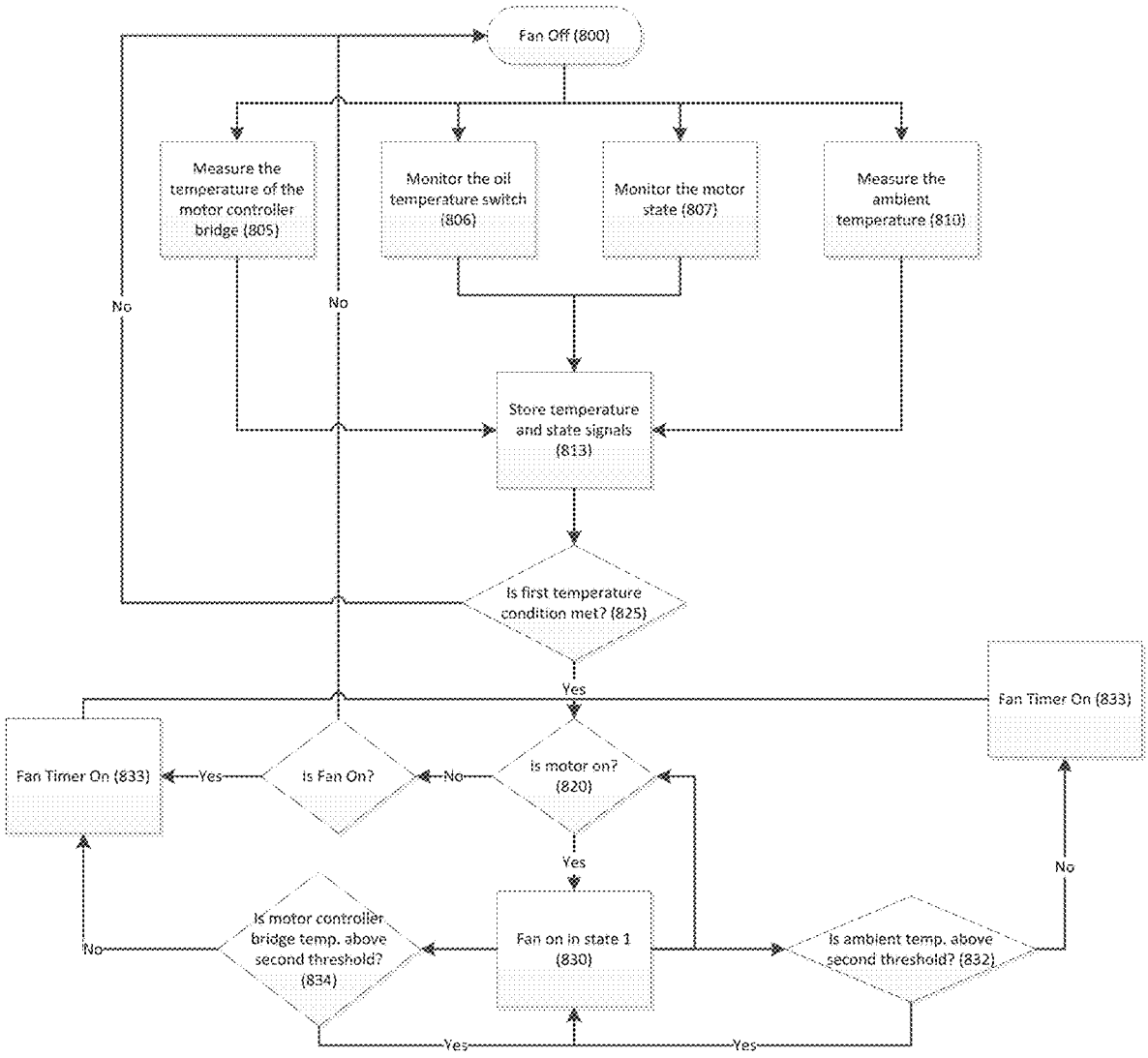
FIG. 9*a* is a flowchart illustrating a first method of cooling a hydraulic power system.

As shown in FIG. 9*a*, when the motor 18 is running (820) and a first temperature condition is met (825), the controller activates the fan 310 in the first mode (830). In the illustrated embodiment, the first temperature condition is met (825) when either the ambient temperature exceeds a first ambient temperature threshold (ATT) (e.g., 30° C.), or the motor controller bridge temperature exceeds a first motor controller 100 bridge threshold (MCBT) (for example, approximately 40° C.). In this situation, the hydraulic power system 10 may be running in an environment that may cause components of the hydraulic power system 10 (e.g., the motor 18, valves, electronics, etc.) to overheat. An ambient temperature below the first ATT may be unlikely to overheat the components of the hydraulic power system 10 by itself, and a motor controller bridge temperature below the MCBT is unlikely to overheat the motor controller bridge. Therefore, the controller 100 may turn off the fan 310 when the ambient temperature is less than the first ATT or the motor controller bridge temperature below the MCBT in order to conserve energy and fan life.

The hydraulic power system 10 itself may not yet be warm just following being powered on, but environmental conditions (i.e., ambient temperature) can cause the hydraulic power system 10 to overheat. Powering the fan 310 on directly into the first mode (i.e., from an off state to the first mode of operation) (830) when the motor 18 is turned on (820), may prevent the hydraulic power system 10 from overheating in an extremely warm environment (i.e., where the ambient temperature is above the first ATT), since running the motor 18 will create more heat and cause the hydraulic power system 10 temperature to increase beyond the first ATT.

The fan 310 can remain on (830) as long as the motor 18 is operating, the ambient temperature is above the first ATT, or the motor controller 100 bridge temperature is above the first MCBT. In some embodiments, when the motor 18 is deactivated (820), the controller 100 initiates a timer (833). The controller 100 may deactivate the fan 310 (800) once the timer exceeds a predetermined time interval. The components of the hydraulic power system 10 become warmer during operation of the motor 18, but will not warm as much while the motor 18 is off because the hydraulic power system 10 is not operating (e.g., hydraulic fluid is not being pumped to a power tool like a torque wrench). Turning off the motor 18 (820) may avoid transmitting additional heat to the components of the hydraulic power system 10. In order to conserve energy, heat may be dissipated through natural convection. In very hot environments, the controller 100 may operate the fan 310 to remain on, or turn on, even when the motor 18 is off in order to provide additional cooling.

In some embodiments, the controller 100 will activate the timer (833) when the ambient temperature drops below a second ambient temperature threshold (ATT) (for example, approximately 25° C.) (832), the second ATT being less than the first ATT. Since the ambient temperature in a given area may fluctuate and repeatedly turning the fan 310 on and off as the temperature hovers around the first ATT would be inefficient, the second ATT can be set to identify a significant drop in ambient temperature. The components of the hydraulic power system 10 may still overheat because of the heat generated from running the motor 18, so the second ATT can be set at a temperature below which the ambient temperature is cool enough so that the components of the hydraulic power system 10 will not overheat even if the motor 18 is running. Once the controller 100 determines that the timer exceeds a predetermined time interval has elapsed, the fan 310 is turned off (800).

The timer may also be activated (833) when the motor controller bridge temperature drops below a second MCBT (e.g., 35° C.) (834) that is less than the first MCBT. Keeping the fan on for a set period of time after the motor controller bridge temperature drops below a second MCBT ensures the motor controller bridge is sufficiently cooled. Once controller 100 detects that the timer exceeds a predetermined time interval, the fan 310 is turned off (800).

Figure 9B:
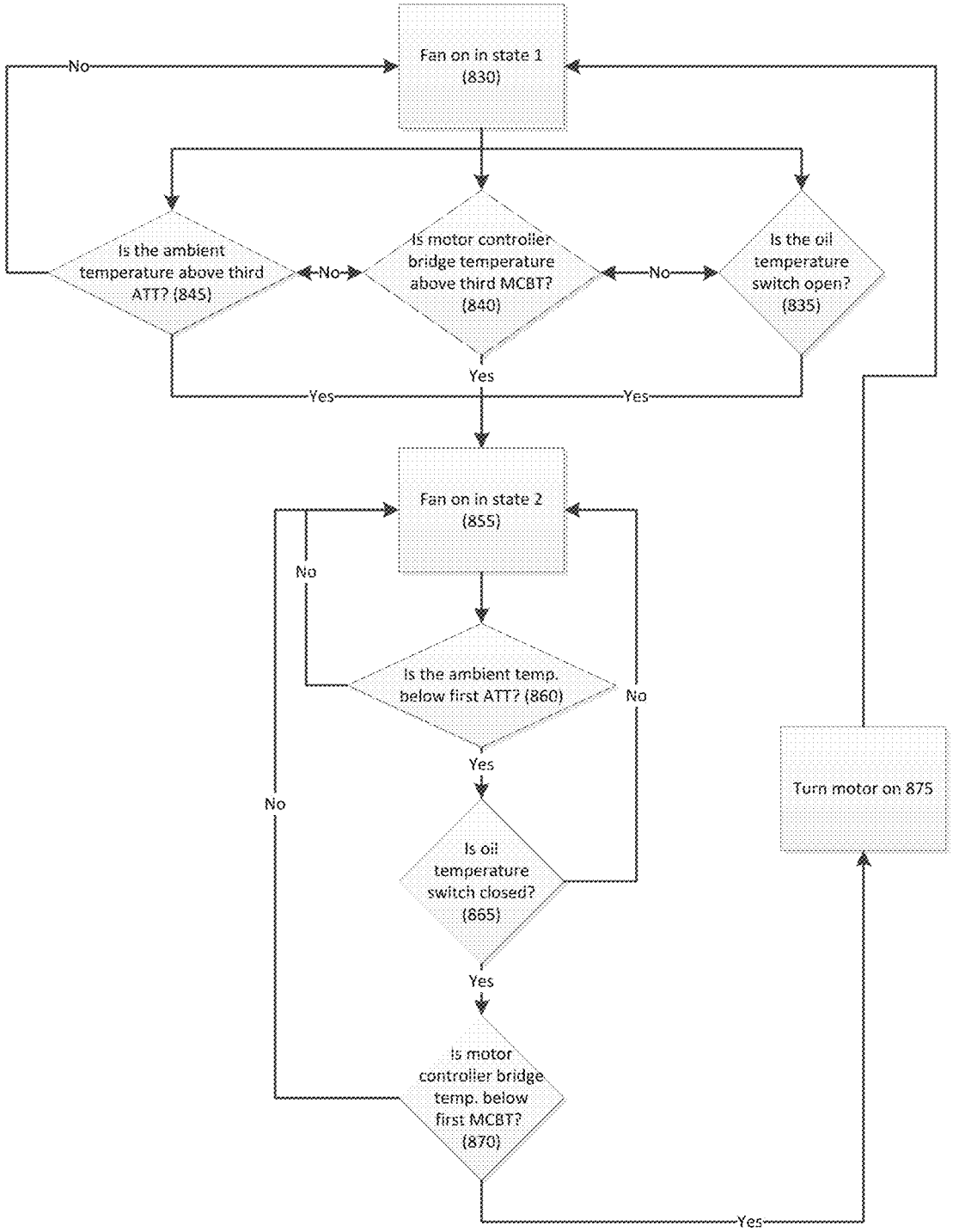
FIG. 9*b* is a flowchart illustrating a second method of cooling a hydraulic power system.

As shown in FIG. 9*b*, instead of turning off, the fan 310 may be switched from the first mode (830) to the second mode (855). Operating the fan in the second mode (855) provides active cooling of the hydraulic power system 10, for example, when specific systems become hot. In the illustrated embodiment, the hydraulic power system 10 (specifically, the controller 100) will change from operating the fan 310 in the first mode (830) to operating the fan 310 in the second mode (855) when at least one of the following conditions are met: the oil temperature switch is open (835) (described further below), the ambient temperature is above a third ambient temperature threshold (ATT) (e.g., 35° C.) (845) that is greater than the second ATT, or the motor controller bridge temperature is above a third MCBT (e.g., 50° C.) (840) that is greater than the third ATT.

In some applications, when ambient temperature is above the first ATT, the components of the hydraulic power system 10 could overheat, when combined with running the motor 18. Above the third ATT (845), the components of the hydraulic power system 10 have a greater likelihood of overheating, regardless of whether or not the motor 18 is providing additional heat. The fan 310 may be operated in the second mode (855), even while the motor 18 is idling, in order to maintain an appropriate pump temperature once the motor 18 is turned back on.

The oil temperature switch opens (835) if a measured oil (or other hydraulic fluid) temperature exceeds a predefined oil temperature threshold. The hydraulic power system 10 includes a reservoir (not shown) that stores oil or other hydraulic fluid. Operating the motor 18 drives the oil from the reservoir to the attachment. If the fluid is not cooled, the fluid temperature can increase with each successive cycle of being pumped to the attachment and returning to the reservoir. Warm oil assists with pump performance, but hot oil may damage the hydraulic power system 10 and/or the tool. The oil temperature switch is normally closed, and opens when the oil temperature exceeds the oil temperature threshold. Even when the motor 18 turned off (e.g., because the motor was idling or because of an overheating error), the controller 100 continues to operate the fan 310 in the second mode to cool the fluid so that the hydraulic power system 10 would return to normal operating conditions the next time the user actuated the hydraulic power system 10.

The motor controller bridge generates heat while the motor 18 operates. The motor controller bridge may be capable of withstanding temperatures greater than the ambient temperature (e.g., the third ATT), and an operational temperature of the motor controller bridge and the motor 18 may be greater than the measured ambient temperature. Above the third MCBT (840), the motor controller bridge has overheated or is likely to overheat. The controller 100 runs the fan 310 in order to cool the motor controller bridge, even when the motor 18 is idling, so that the motor 18 is ready for the next time the user actuates the hydraulic power system 10.

The hydraulic power system 10 may have experienced an overheating error when the ambient temperature is above the third ATT (845), the oil temperature switch is open (835), or the motor controller bridge temperature is above the third MCBT (840). The second mode of the fan 310 is different from the first mode in that the fan 310 is run irrespective of the motor 18 (i.e., the fan 310 is run even when the motor 18 is not running). The fan 310 may be turned off in the first mode, allowing natural convection to cool the hydraulic power system 10 because the pump components are generally not hot enough to trigger an overheating error. Once any of the conditions necessary to trigger the second mode are met/detected by the controller 100 (e.g., 835, 840, 845), the controller 100 keeps the fan 310 on to cool the hydraulic power system 10, and prepare the hydraulic power system 10 to operate again.

In the illustrated embodiment, the fan 310 remains in the second mode (855) as long as the oil temperature switch is open, the ambient temperature is above the third ATT, and the motor controller bridge temperature is above the third MCBT. That is, unlike the first mode in which the fan 310 is turned off after either the motor 18 is turned off (820—FIG. 9*a*) or the ambient temperature drops below the second ATT (832—FIG. 9*a*), the fan 310 will only leave the second mode when all three measured temperatures have been reduced. In the illustrated embodiment, the oil temperature switch must be closed (865), the ambient temperature must drop below the first ATT (860), and the motor controller bridge temperature must drop below the first MCBT (870). The thresholds required for the hydraulic power system 10/controller 100 to leave the second mode (i.e., the first ATT and the second MCBT) and avoid an overheating error, are less than the thresholds required to enter the second mode (i.e., the third ATT and the first MCBT) in order to avoid having the hydraulic power system 10 repeatedly rise and fall above the threshold and possibly trigger an error.

In the event that the user wants to continue to operate the hydraulic power system 10 (e.g., after clearing an overheating error), the controller 100 switches the fan 310 to the first mode (830), and continue to operate the fan 310 until the motor 18 turns off (820—FIG. 9*a*), or the ambient temperature drops below the second ATT (832—FIG. 9*a*). Alternatively, the fan 310 is turned off (800) directly from the second mode if the motor 18 is not turned on.

Figure 9C:
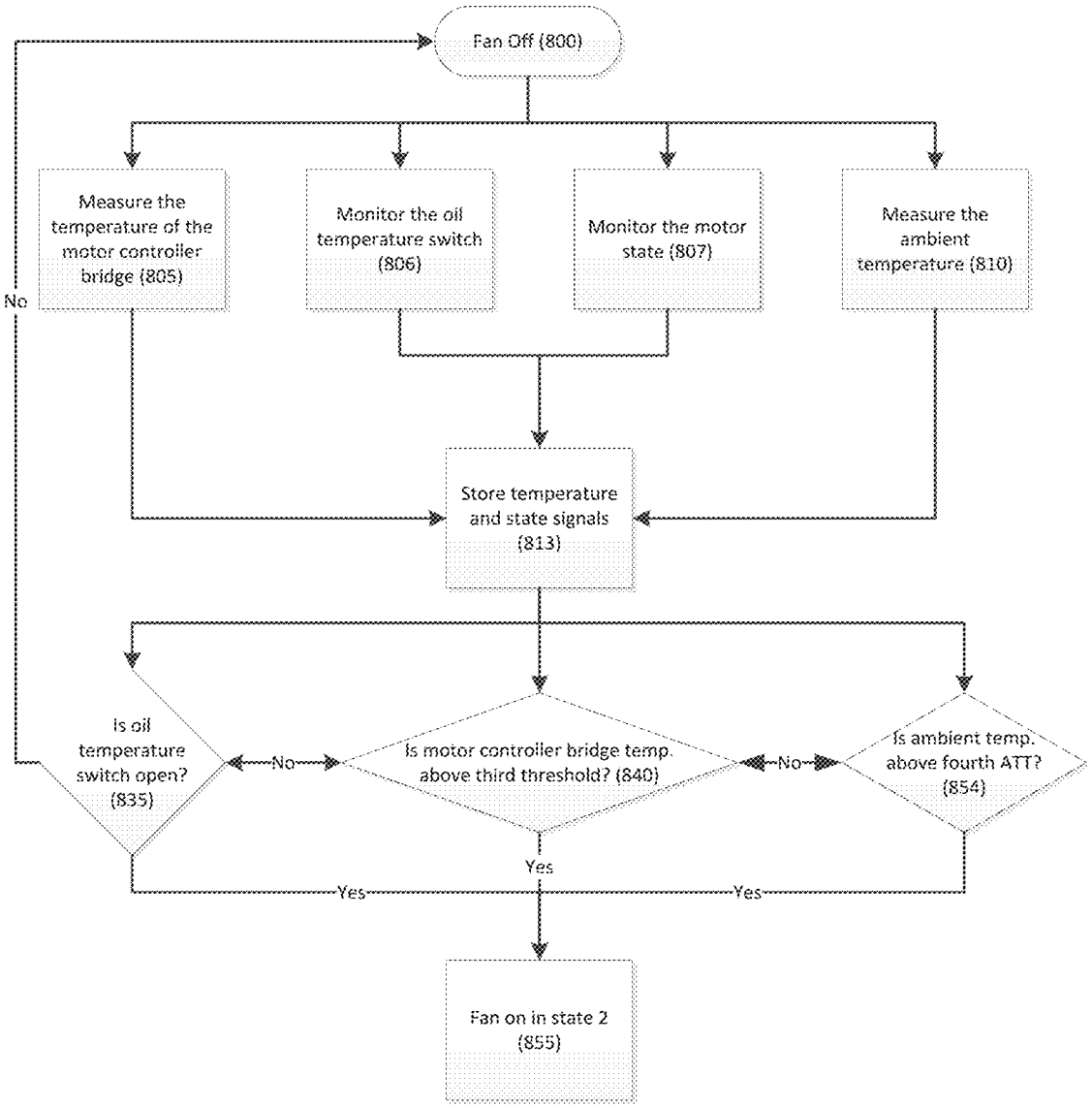
FIG. 9*c* is a flowchart illustrating a third method of cooling a hydraulic power system.

As shown in FIG. 9*c*, in other situations, the fan 310 may be activated directly into the second mode (855), and bypass the first mode (i.e., the fan 310 may be turned on even if the motor 18 is not on) (830—FIG. 9*a*). For example, this may occur when either the oil temperature switch is open (835), the motor controller bridge temperature is above the third MCBT (840), or the ambient temperature is above a fourth ATT (e.g., 40° C.) (854) that is above the first ATT. The controller 100 operates the fan 310 directly in the second mode (855) because the motor 18 cannot turn on until the overheating error is cleared (i.e., the temperature is reduced). In order to expedite the cooling process (i.e., so that it takes less time than natural convection alone), the controller 100 activates the fan 310 in the second mode (855) to reduce the oil and motor controller bridge temperatures, and clear the overheating error. Once the fan 310 sufficiently cools the pump components so that the oil temperature switch is closed (865—FIG. 9*b*) and the motor controller bridge temperature is below the first MCBT (870—FIG. 9*b*), the motor 18 can run and the fan can be operated in the first mode (830—FIG. 9*b*), assuming the ambient temperature is below the first ATT (860—FIG. 9*b*).

In some embodiments, thermal and heat transfer data (e.g., ambient temperatures, temperatures of various components, etc.) collected during operation of the hydraulic power system 10 may be transmitted to and stored in a memory (for example, the memory 115), which include an onboard memory and/or an external memory. In some embodiments, the data in the memory can be accessed by a user without the hydraulic power system 10 present.

In some embodiments, a supply voltage of the hydraulic power system 10 is monitored via the controller 100 (upon connection to a power supply and turned on) for any unstable voltage characteristics that would indicate that the supply is of an abnormal power (known as dirty power). Such voltage characteristics include, for example, low power factor, voltage variations, frequency variations, and power surges. In some embodiments, to test for such conditions, the controller 100, upon initial power on of the system 10, may activate a small load (for example, via the motor 18) and monitoring, via one or more of the sensors 116, for a voltage drop or rise. The controller 100, based on the voltage drop/rise may accordingly adjust the voltage operating limits of the system 10 to allow the system 10 to run on the dirty power supply.

Preferred embodiments have been described in considerable detail. Many modifications and variations to the preferred embodiments described will be apparent to a person of ordinary skill in the art. Therefore, the disclosure is not limited to the embodiments described. One or more independent features and independent advantages may be set forth in the claims.

What is claimed is:

1. A method for controlling operation of a hydraulic power system coupled to a torque wrench, the hydraulic power system including a motor, a valve, and a controller, the method comprising:

defining a user set pressure;

advancing a fluid actuator of the torque wrench toward the user set pressure, the torque wrench applying torque to a work piece;

calculating a change in pressure per unit time during an initial advance operation of the fluid actuator below the user set pressure;

storing the calculated change in pressure per unit time as a reference pressure slope;

during a subsequent advance of the fluid actuator, measuring a change in pressure of fluid in the fluid actuator of the torque wrench;

comparing the measured change in pressure per unit time to the reference pressure slope; and retracting the fluid actuator of the torque wrench when the change in pressure is greater than the stored pressure slope.

2. The method of claim 1, further comprising detecting a first inflection interval at which a change in pressure per unit time transitions from a value that is greater than the reference pressure slope to a value that is less than the reference pressure slope.

3. The method of claim 2, wherein the reference pressure slope is a first reference pressure slope, the method further comprising detecting a second inflection interval at which a change in pressure per unit time transitions from a value that is less than a second reference pressure slope to a value that is greater than the first reference pressure slope.

4. The method of claim 3, wherein detecting the second inflection interval is performed following a predetermined amount of time following the first inflection interval and wherein the change in pressure per unit time exceeds a predetermined threshold.

5. The method of claim 3, further comprising, retracting the torque wrench when the change in pressure is less than the reference pressure slope; and initiating an auto-complete cycle by advancing and retracting the torque wrench once more.

6. The method of claim 5, further comprising, prior to initiating the auto-complete cycle, determining whether at least one of the following conditions is satisfied for initiating the auto-complete cycle:

a first condition in which, after the second inflection interval is detected, a difference between a measured pressure and a user-specified pressure is below a predetermined threshold, and the measured change in pressure per unit time is less than the second reference pressure slope; and a second condition in which, after the first inflection interval is detected, a difference between a measured pressure and a user-specified pressure is below a predetermined threshold, and a pressure measured while retracting the fluid actuator from a point at which the change in pressure is greater than the stored pressure slope is approximately equal to the user-specified pressure.

7. The method of claim 1, further comprising, starting a cycle in response to receiving an actuation at a first button;

prior to the advancing step, receiving an actuation at a second button of the controller;

adjusting a relief valve to a maximum set pressure;

receiving an actuation at the first button;

outputting at least one of a light output and a haptic pulse from the controller; and detecting a release of the first button and the second button.

8. The method of claim 7, further comprising

Subsequent the detecting step, receiving an actuation at the second button and a third button; and clearing the user set pressure.

9. The method of claim 7, further comprising, comparing a pressure of the torque wrench to the maximum set pressure; and retracting the torque wrench when the pressure of the torque wrench is less than the maximum set pressure.

10. The method of claim 7, further comprising, retracting the torque wrench when a pressure of the torque wrench is less than the maximum set pressure and when the pressure approaches the maximum set pressure at a slope less than the reference pressure slope; and starting an auto-complete cycle by advancing and retracting the torque wrench once more.

11. The method of claim 1, wherein the reference pressure slope is a first reference pressure slope, the method further comprising, calculating a second reference pressure slope based on the user set pressure, the first reference pressure slope greater than the second reference pressure slope.

12. The method of claim 11, wherein advancing the torque wrench to the user set pressure occurs during an initial advancing step.

13. The method of claim 12, wherein the torque wrench is applying torque to a work piece during the initial advance step.

14. The method of claim 11, further comprising, determining the location of a first inflection interval at which a change in pressure changes from greater than the first pressure reference slope to less than the first pressure reference slope;

determining the location of a second inflection interval at which the change in pressure changes from less than the second reference pressure slope to greater than the first pressure reference slope; and wherein the retracting step occurs subsequent to determining the location of the second inflection interval.

15. The method of claim 1, further comprising, detecting actuation of one of a first button and a second button;

when actuation at the first button is detected, subsequently detecting a release of the first button, and starting an auto-cycle to automatically control the advancing and retracting steps;

when actuation at the second button is detected, starting a manual cycle to manually control the advancing and retracting steps.

16. The method of claim 15, further comprising outputting at least one of light or vibrations from the controller to alert a user to release the second button and retract the fluid actuator in the manual cycle.

17. The method of claim 1, further comprising detecting whether a stick-slip condition has occurred.

18. The method of claim 1, further comprising detecting the presence of an abnormal power supply, and when an abnormal power supply is detected, adjusting voltage operating limits of the hydraulic power system.

* * * * *